US011677198B2

(12) United States Patent
Stanislaw et al.

(10) Patent No.: US 11,677,198 B2
(45) Date of Patent: Jun. 13, 2023

(54) FIELD TERMINABLE RJ45 PLUG ASSEMBLY

(71) Applicant: Panduit Corp., Tinley Park, IL (US)

(72) Inventors: David C. Stanislaw, Cicero, IL (US); Andrew Ciezak, Georgetown, TX (US); Frank M. Straka, Orland Park, IL (US); Robert E. Fransen, Orland Park, IL (US); Joshua A. Valenti, Ferndale, IL (US); Vytas J. Vaitkus, Orland Park, IL (US); Michael A. Tome, Riverside, IL (US); Paul W. Wachtel, Arlington Heights, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 17/558,352

(22) Filed: Dec. 21, 2021

(65) Prior Publication Data

US 2022/0190531 A1 Jun. 16, 2022

Related U.S. Application Data

(63) Continuation of application No. 15/779,565, filed as application No. PCT/US2016/066339 on Dec. 13, 2016, now abandoned.

(Continued)

(51) Int. Cl.
*H01R 24/64* (2011.01)
*H01R 4/2429* (2018.01)

(Continued)

(52) U.S. Cl.
CPC ..... *H01R 24/64* (2013.01); *H01R 4/2429* (2013.01); *H01R 13/502* (2013.01); *H01R 13/6466* (2013.01); *H01R 13/6474* (2013.01)

(58) Field of Classification Search
CPC .... H01R 23/025; H01R 24/64; H01R 4/2429; H01R 13/502; H01R 13/6466; H01R 13/6474

(Continued)

(56) References Cited

U.S. PATENT DOCUMENTS 5,522,747 A 6/1996 Saito et al.
5,975,936 A 11/1999 Yamaguchi et al.

(Continued)

FOREIGN PATENT DOCUMENTS

CN 1245985 A 3/2000
CN 101540457 A 9/2009

(Continued)

*Primary Examiner* — Gary F Paumen
(74) *Attorney, Agent, or Firm* — Christopher S. Clancy; James H. Williams; Christopher K. Marlow

(57) ABSTRACT

A field terminal plug assembly including an RJ45 plug connected to a termination zone. The termination zone includes a wire cap, a rear sled, and an electrical board assembly with attached insulation displacement contacts (IDCs) electrically connected to the twisted wire-pairs of assembly cable. The wire cap is configured to terminate twisted wire-pairs of a communications cable to the IDCs when the wire cap is inserted into the rear sled. The IDCs contain at least a first and a second IDC, the first IDC having a first horizontal length and a first vertical length and the second IDC having a second horizontal length and a second vertical length. The first vertical length does not equal the second vertical length but the first vertical length plus the first horizontal length equals the second vertical length plus the second horizontal length.

10 Claims, 39 Drawing Sheets

Related U.S. Application Data

(60) Provisional application No. 62/397,077, filed on Sep. 20, 2016, provisional application No. 62/335,253, filed on May 12, 2016, provisional application No. 62/267,640, filed on Dec. 15, 2015.

(51) Int. Cl.
*H01R 13/502* (2006.01)
*H01R 13/6466* (2011.01)
*H01R 13/6474* (2011.01)

(58) Field of Classification Search
USPC ..... 439/418
See application file for complete search history.

(56) References Cited

U.S. PATENT DOCUMENTS

| | | | | |
|---|---|---|---|---|
| 5,989,071 | A | 11/1999 | Larsen et al. | |
| 6,010,353 | A | 1/2000 | Ensz et al. | |
| 6,056,586 | A | 5/2000 | Lin | |
| 6,109,954 | A | 8/2000 | Lin | |
| 6,270,372 | B1 | 8/2001 | Jenner et al. | |
| 6,368,148 | B1 | 4/2002 | Fogg et al. | |
| 6,371,793 | B1 | 4/2002 | Doorhy et al. | |
| 6,582,247 | B2 | 6/2003 | Siemon | |
| 6,592,395 | B2 | 7/2003 | Brown et al. | |
| 6,731,793 | B1 | 5/2004 | Usbeck et al. | |
| 6,932,640 | B1 | 8/2005 | Sung | |
| 7,422,467 | B2 | 9/2008 | Siev et al. | |
| 7,476,120 | B2 | 1/2009 | Patel et al. | |
| 7,503,798 | B2 | 3/2009 | Hashim | |
| 8,052,461 | B2 | 11/2011 | Wang | |
| 8,287,317 | B2 | 10/2012 | Straka et al. | |
| 8,690,598 | B2 * | 4/2014 | Bolouri-Saransar | H01R 13/6469 439/418 |
| 8,870,589 | B2 * | 10/2014 | Su | H01R 24/64 439/418 |
| 8,968,024 | B2 | 3/2015 | Maranto et al. | |
| 8,992,247 | B2 * | 3/2015 | Aekins | H05K 3/403 439/418 |
| 2003/0228776 | A1 | 12/2003 | Egan et al. | |
| 2009/0142968 | A1 * | 6/2009 | Goodrich | H01R 13/501 439/676 |
| 2012/0088412 | A1 * | 4/2012 | Mattson | H01R 29/00 439/660 |
| 2013/0004648 | A1 | 1/2013 | Taillan et al. | |
| 2013/0189873 | A1 | 7/2013 | Maranto et al. | |

FOREIGN PATENT DOCUMENTS

| | | |
|---|---|---|
| EP | 0473046 A2 | 3/1992 |
| JP | H06-079085 | 11/1994 |
| JP | 2000-067979 | 3/2000 |
| JP | 2012-500466 | 1/2012 |
| JP | 2013-544010 A | 12/2013 |

* cited by examiner

WireCap

Traces

Blades

FIELD TERMINABLE RJ45 PLUG ASSEMBLY

CROSS-REFERENCE TO RELATED APPLICATION(S)

This application is a continuation of U.S. patent application Ser. No. 15/779,565, filed on May 29, 2018, and claims priority to International Patent Application No. PCT/US2016/066339, filed on Dec. 13, 2016, U.S. Provisional Patent Application No. 62/397,077, filed on Sep. 20, 2016, U.S. Provisional Patent Application No. 62/335,253, filed on May 12, 2016, and U.S. Provisional Patent Application No. 62/267,640, filed on Dec. 15, 2015, the entirety of all of which are hereby incorporated by reference herein.

FIELD OF THE INVENTION

The present invention relates generally to RJ45 type plug connectors and specifically to a field terminable RJ45 plug assembly that uses wire cap technology for termination.

BACKGROUND OF THE INVENTION

Global demand for a Category 6A (CAT6A) RJ45 field terminable plug has been identified to address the growing demand for new devices that are being deployed in Ethernet-type communication systems. These new devices that are being deployed include wireless access points, security cameras, and audio visual (AV) extenders. The access to these devices is often restricting and requires a RJ45 solution that will fit within these tight spaces. There are currently commercially available solutions for a CAT6A RJ45 plug. These current solutions, however, are not preferred for a number of reasons. First, there are numerous small components that are challenging to assemble in the field. Second, the length and rigidity of the CAT6A plug may prevent it from being used in confined space applications. Third, these current CAT6A plugs can only be used over a fairly narrow range of cable diameters and wire gauges, forcing contractors in the field to have multiple plugs to handle difference cable types.

What is needed is a field terminable RJ45 plug that is intuitive to assemble in field conditions, compact in length, is flexible enough to make RJ45 terminations in confined areas with limited access, can accommodate cables with an outer diameter that ranges from 0.151" to 0.332", can accommodate cables with a range of wire gauges from 22-26 AWG, and can fit into a ¾" conduit.

SUMMARY OF THE INVENTION

A field terminal plug assembly including an RJ45 plug connected to a termination zone. The termination zone includes a wire cap, a rear sled, and an electrical board assembly with attached insulation displacement contacts (IDCs) electrically connected to the twisted wire-pairs of assembly cable. The wire cap is configured to terminate twisted wire-pairs of a communications cable to the IDCs when the wire cap is inserted into the rear sled. The IDCs contain at least a first and a second IDC, the first IDC having a first horizontal length and a first vertical length and the second IDC having a second horizontal length and a second vertical length. The first vertical length does not equal the second vertical length but the first vertical length plus the first horizontal length equals the second vertical length plus the second horizontal length.

In one embodiment, the electrical board assembly can have a printed circuit board with compensation circuitry.

DETAILED DESCRIPTION OF THE PREFERRED EMBODIMENTS

The present invention is a CAT6A field terminable RJ45 plug assembly that terminates to a cable similarly as it would to a jack with a wire cap similar to the ones described in U.S. Pat. Nos. 7,476,120, 7,452,245, and 8,968,024 and is constructed in a manner that enables it to be manipulated so that it can fit into confined spaces.

Figure 1:
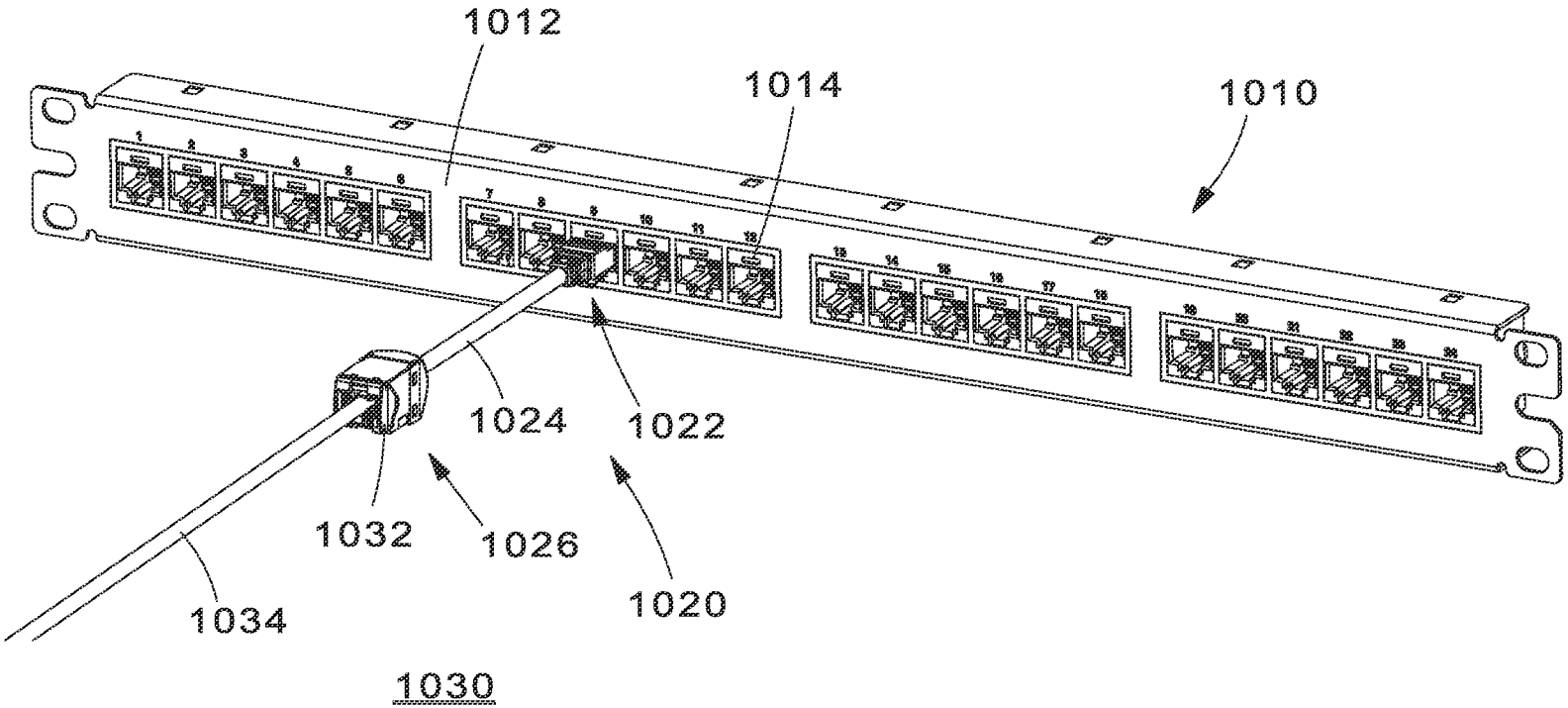
FIG. 1 is an isometric view of a communication system featuring a first embodiment of a plug assembly of the present invention.
Figure 2:
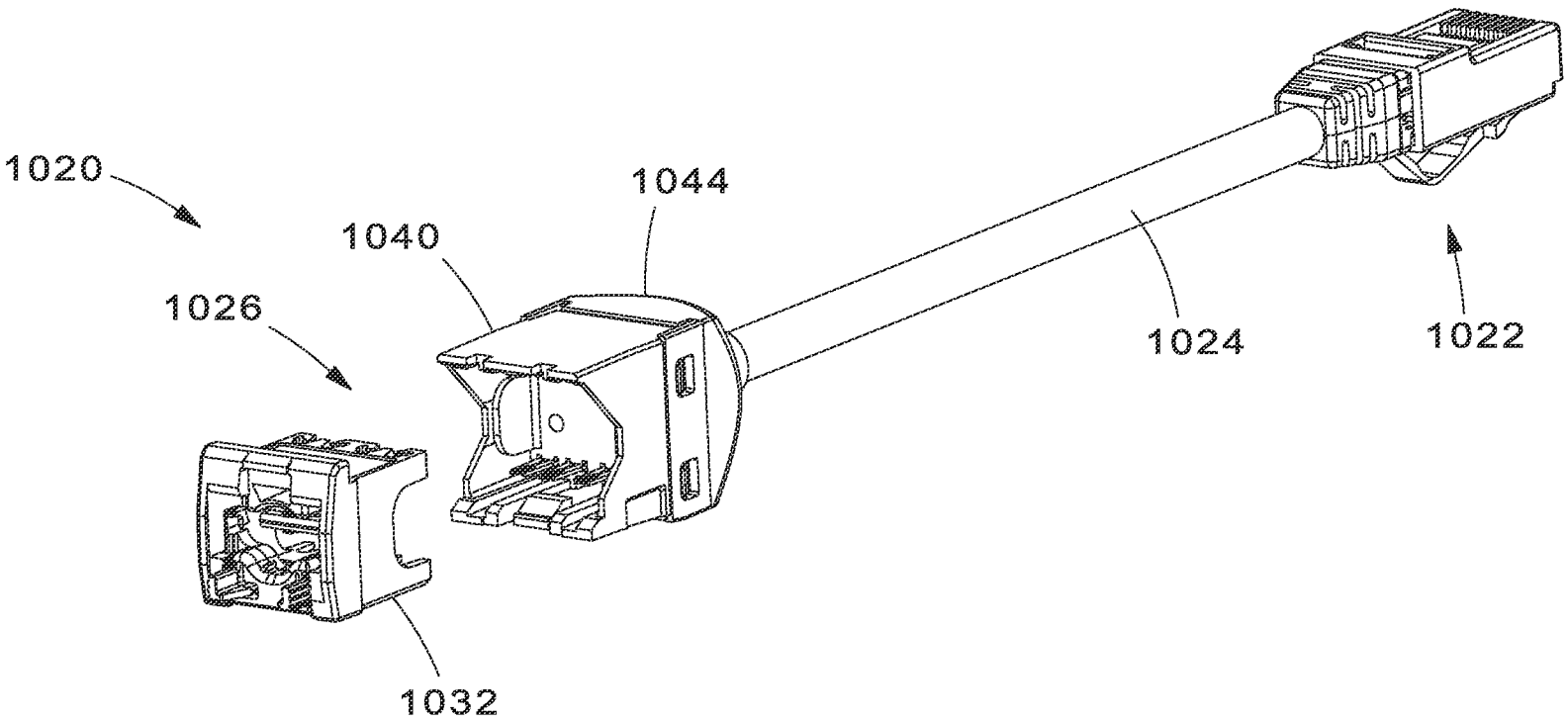
FIG. 2 is an isometric view of a field terminable RJ45 plug assembly.
Figure 3:
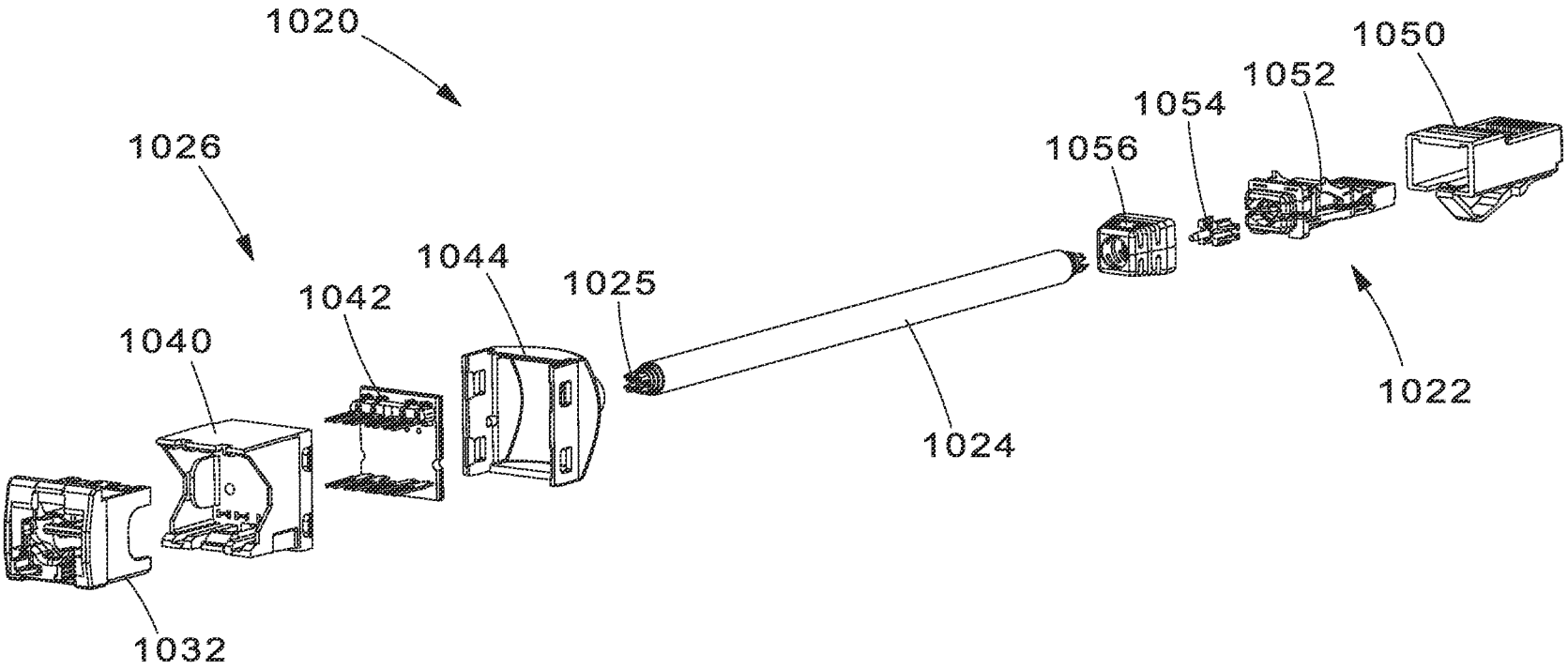
FIG. 3 is an exploded isometric view of the field terminable RJ45 plug assembly of FIG. 2.

FIG. 1 shows communication system 1010 with patch panel 1012 (which may be, but is not limited to, a wireless access point, security camera, or AV extender) populated with RJ45 jacks 1014, field terminable RJ45 plug assembly 1020, and communication cable 1034. FIG. 2 shows a front isometric view of field terminable plug assembly 1020 as a customer would receive it, prior to being terminated onto communication cable 1034. FIG. 3 is an exploded view of field terminable RJ45 plug assembly 1020, which includes plug assembly 1022, CAT6A assembly cable 1024, and termination zone 1026 (which has similarities of the termination process to that of the jack that is described in the patent referenced above).

Plug assembly 1022 includes plug housing assembly 1050, cable containment adapter 1052, divider 1054, and plug boot 1056.

Figure 4:
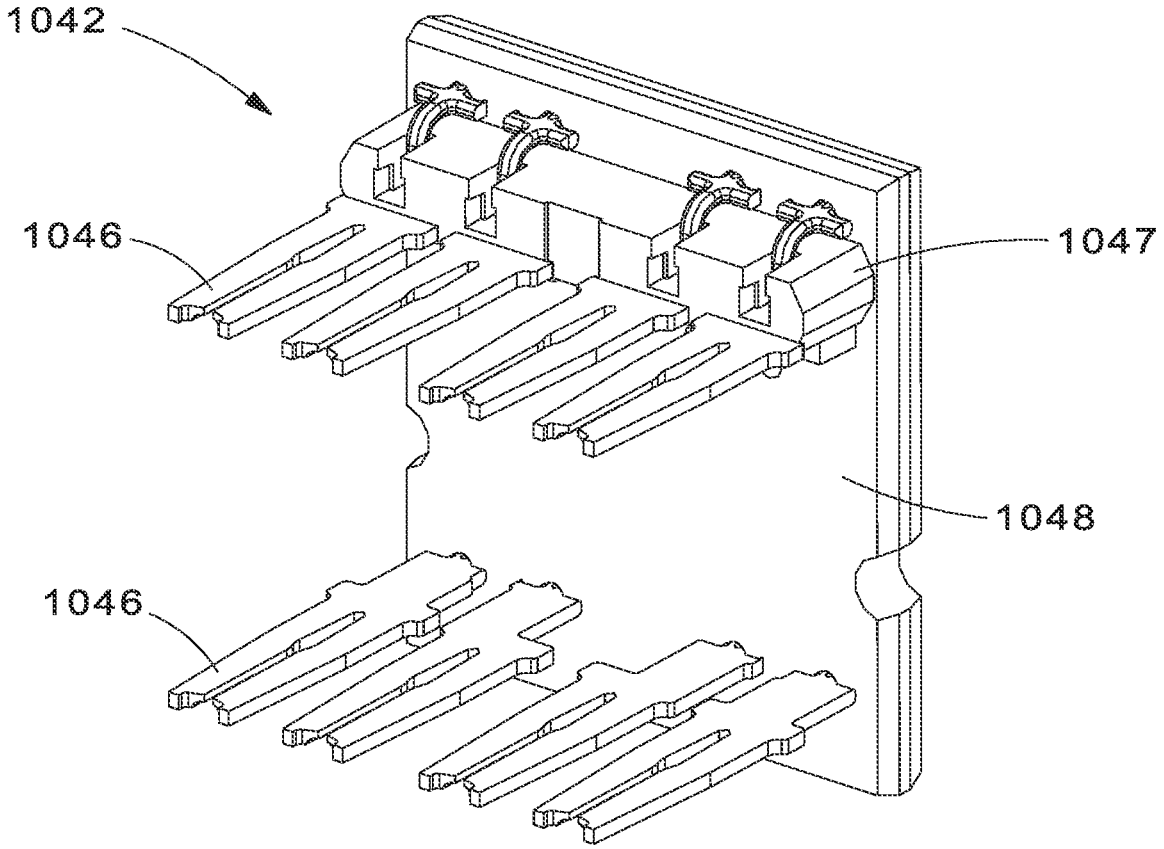
FIG. 4 is a perspective view of an electrical board assembly that can be used with the field terminable RJ45 plug assembly of FIG. 2.

Termination zone 1026 includes rear sled 1040, electrical board assembly 1042, protective cap 1044, and wire cap 1032. FIG. 4 is an isometric view of electrical board assembly 1042, which includes insulation displacing contacts (IDCs) 1046, IDC support 1047, and printed circuit board (PCB) 1048.

CAT6A field terminable RJ45 plug assembly 1020 must meet the plug requirements as defined in ANSI/TIA-568-C.2. For example, there is a near end crosstalk (NEXT) magnitude requirement for all pair combinations. Similarly, there are far end crosstalk (FEXT), return loss (RL), and phase requirements. Plug assembly 1022 is tuned to meet the performance requirements of an RJ45 plug. Therefore, there must be very little additional noise or performance degrading interactions (for example impedance mismatches) occurring in termination zone 1026. If noise in termination zone 1026 is too large, then this region could look like another connector in the channel, which would limit its ability to be used as a field terminable CAT6A RJ45 plug in many applications.

Figure 5:
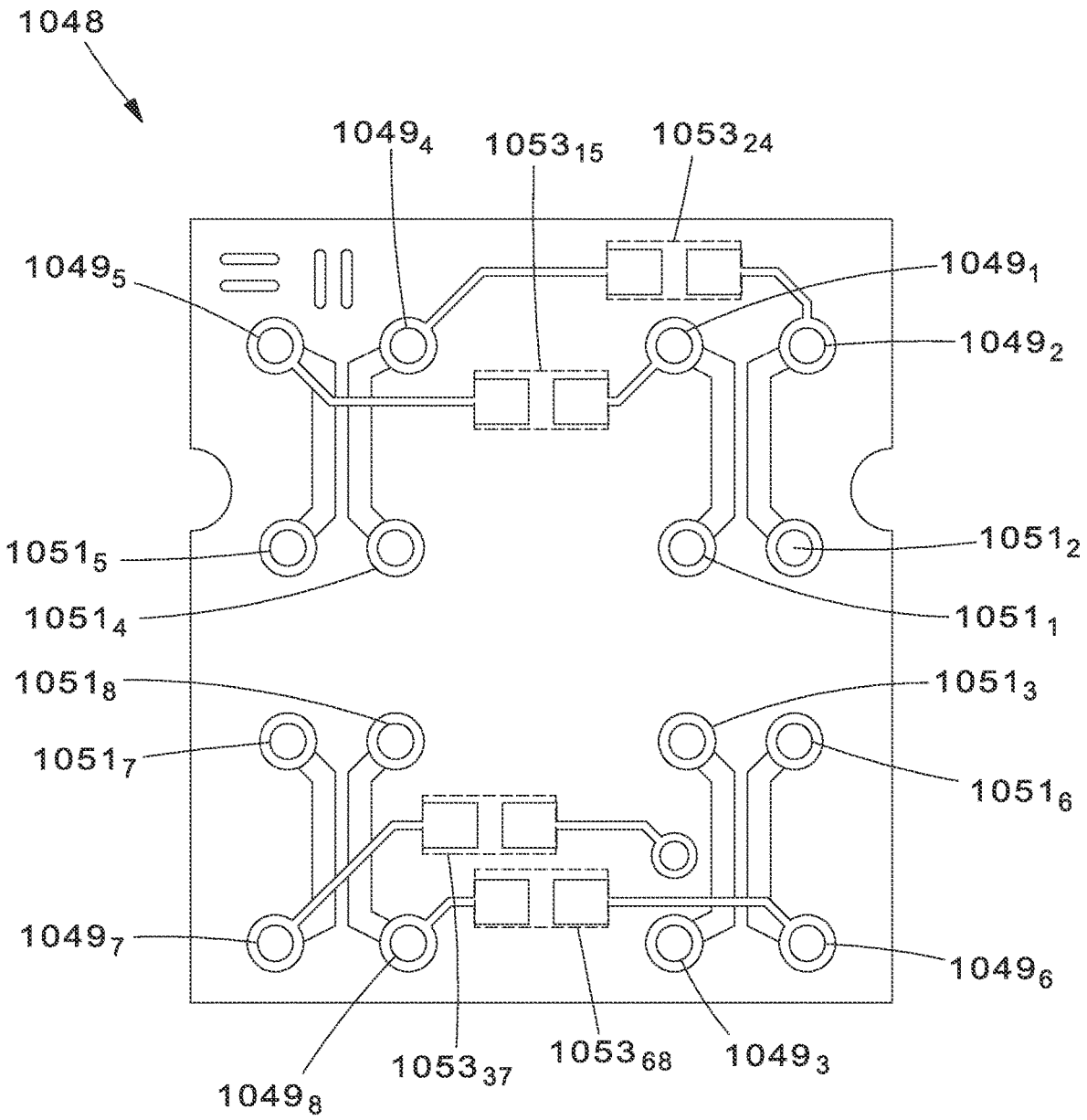
FIG. 5 shows the tracings for a printed circuit board (PCB) for the electrical board assembly of FIG. 4.

FIG. 5 is a front view of PCB 1048. Referencing FIG. 5 the subscript numbers represent RJ45 pin positions as defined by ANSI/TIA-568-C.2. IDCs 1046 are assembled into plated thru holes 1049. Conductors 25 of CAT6A assembly cable 1024 are soldered into plated thru holes 1051. Due to the physical arrangement of IDCs, there exists pair to pair coupling in termination zone 1026 that needs to be compensated. For example, IDC $\mathbf{1046}_4$ is adjacent to IDC $\mathbf{1046}_1$ in rear sled 1040. This creates imbalanced coupling between the 4-5 pair and the 1-2 pair, where this resulting crosstalk adversely affects electrical performance. To mitigate the effects of this crosstalk between IDC $\mathbf{1046}_4$ and IDC $\mathbf{1046}_1$ and improve performance through termination zone 1026, compensation capacitors $\mathbf{1053}_{24}$ and $\mathbf{1053}_{15}$ are used on PCB 1048. Capacitor $\mathbf{1053}_{24}$ adds capacitive coupling between traces 2 and 4. Similarly, capacitor $\mathbf{1053}_{15}$ adds capacitive coupling between traces 1 and 5. Capacitors $\mathbf{1053}_{24}$ and $\mathbf{1053}_{15}$ compensate by adding the proper cumulative magnitude of crosstalk that is roughly 180° out of phase as the crosstalk that is generated between IDC $\mathbf{1046}_1$ and IDC $\mathbf{1046}_4$. This results in cleaner differential transmission lines in the region of termination zone 1026 that do not contribute significant levels of crosstalk that would degrade performance through field terminable RJ45 plug assembly 1020. For the same reasons capacitors $\mathbf{1053}_{24}$ and $\mathbf{1053}_{15}$ are present, capacitors $\mathbf{1053}_{37}$ and $\mathbf{1053}_{68}$ are used to compensate the crosstalk generated between IDC $\mathbf{1046}_3$ and IDC $\mathbf{1046}_8$. Although capacitors 1053 are shown as discrete components, they could alternatively be embedded into the copper layers of PCB 1048, be interdigit capacitors, or may be created by some other means.

Figure 6:
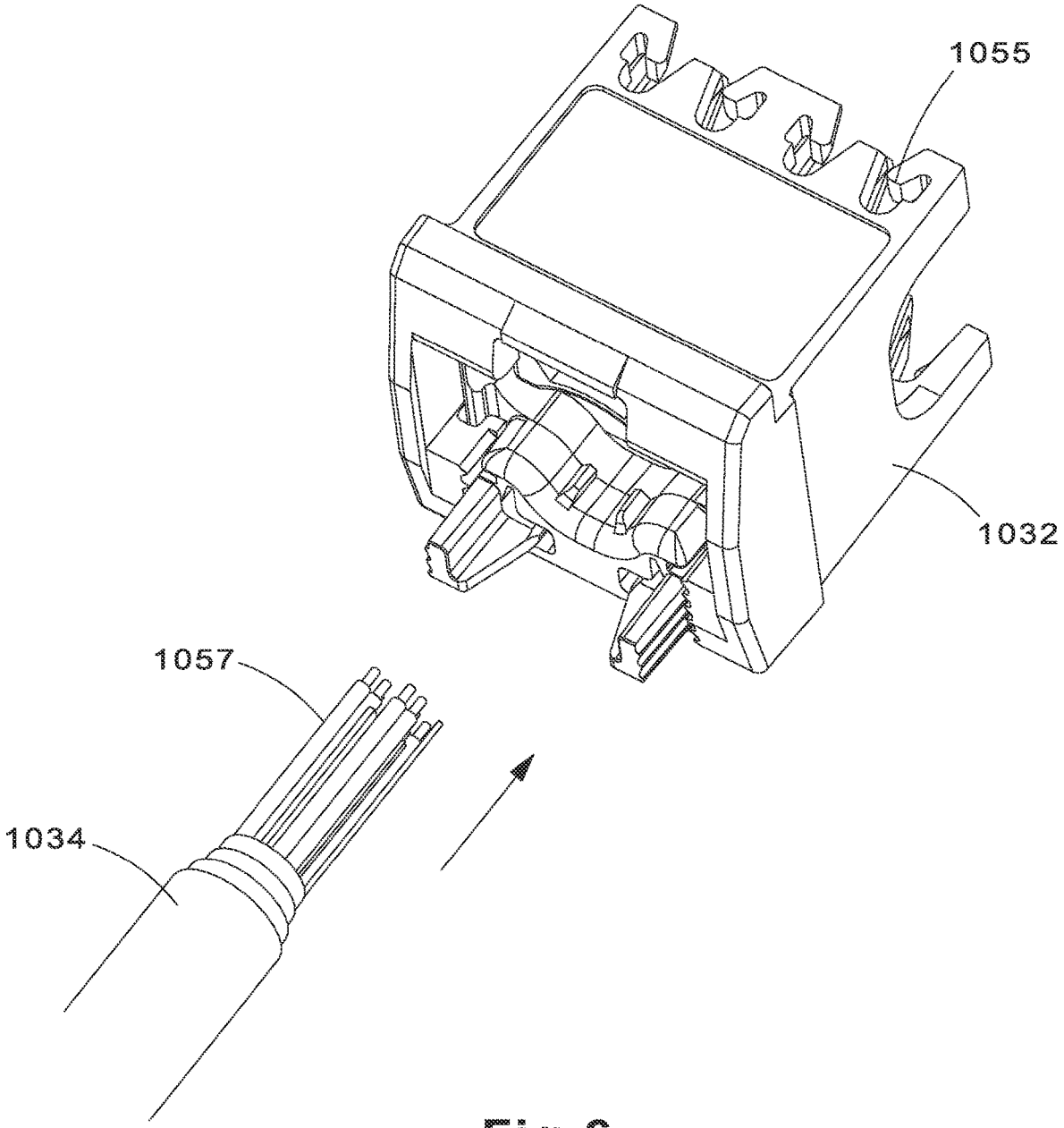
FIGS. 6-8 show the termination of a cable to the field terminable plug assembly of FIG. 2.
Figure 7:
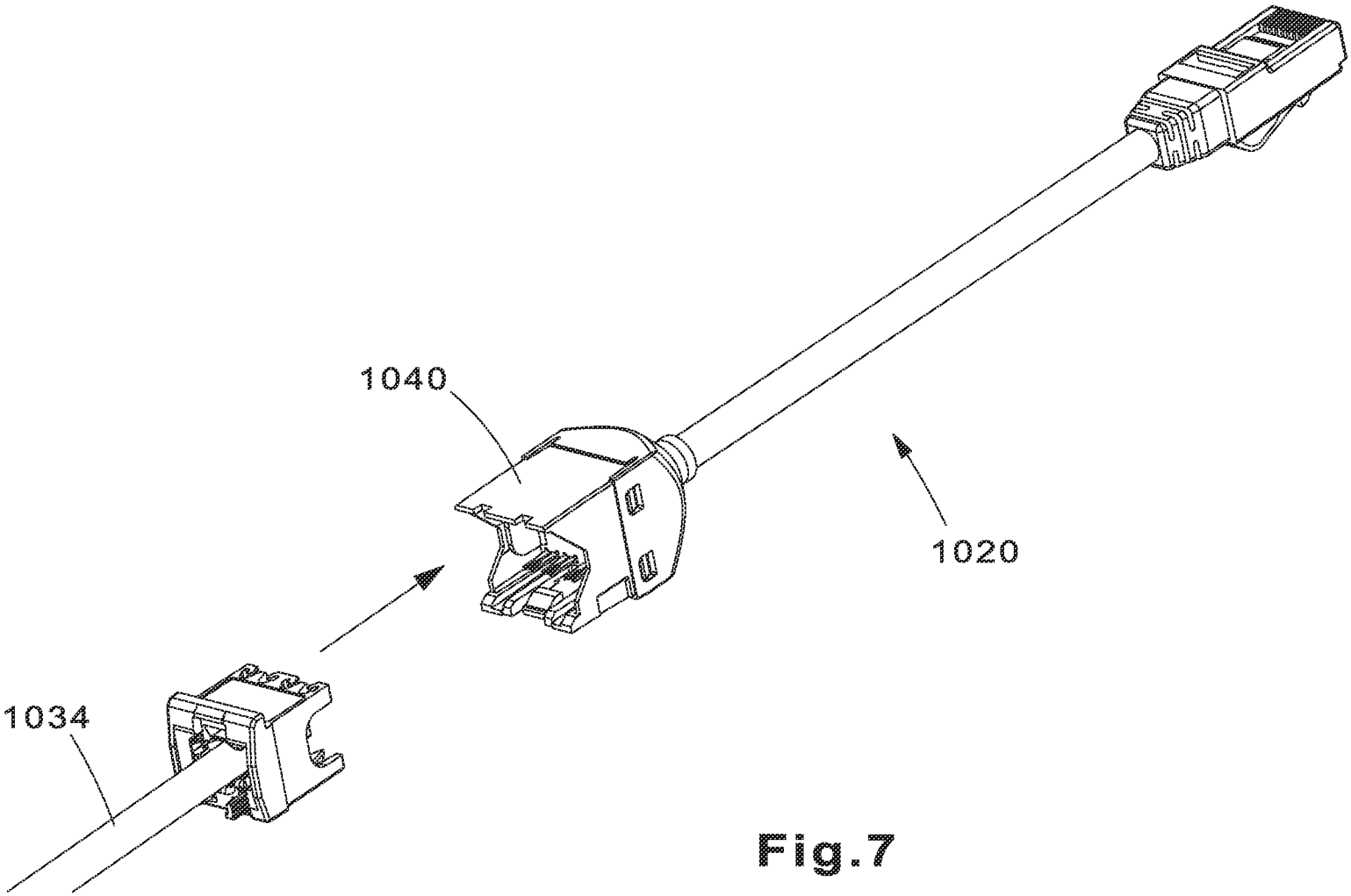
Figure 8:
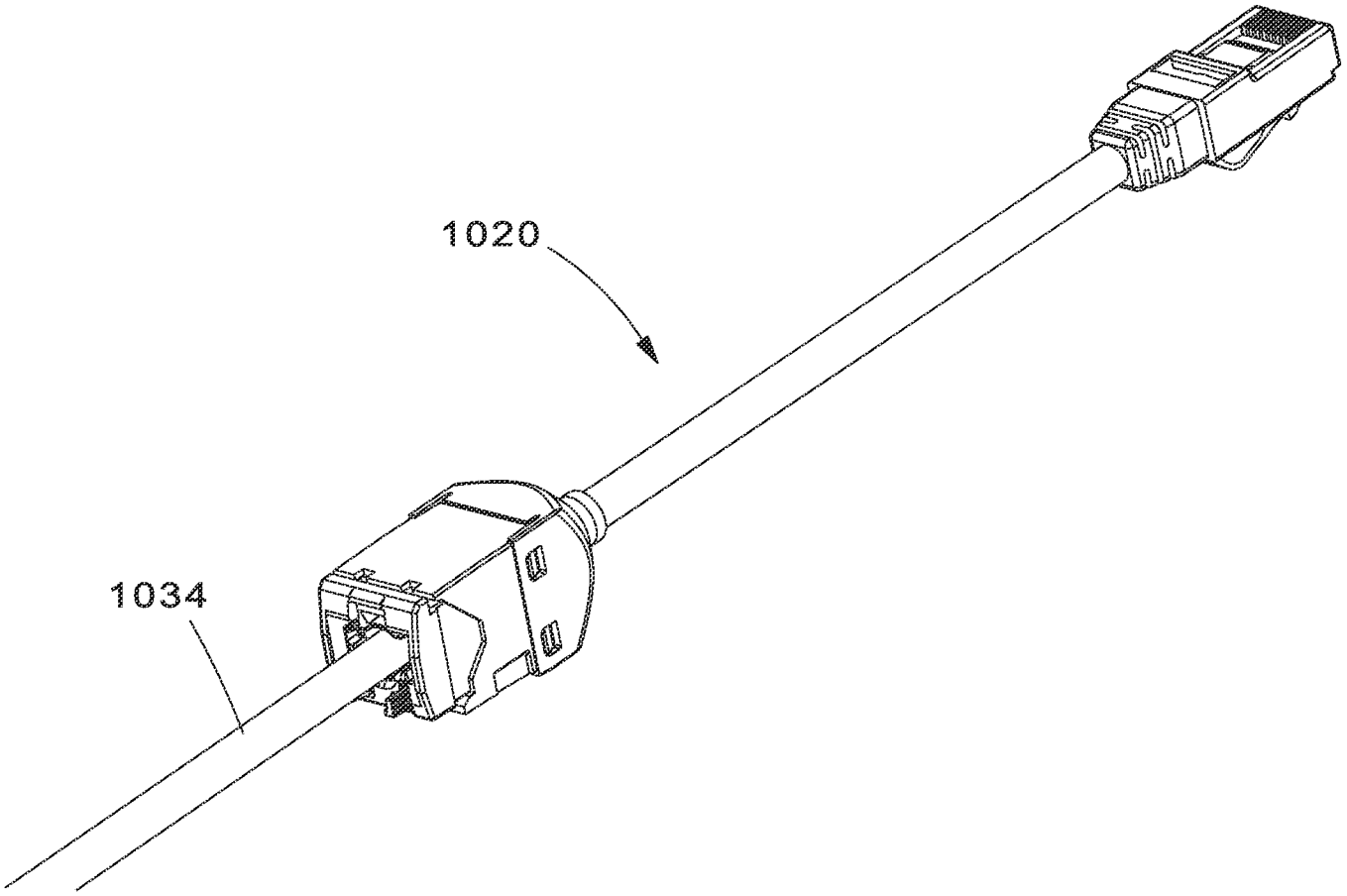

Terminating field terminable RJ45 plug assembly 1020 begins by assembling wire cap 1032 onto twisted pair communication cable 1034 as shown in FIG. 6. Each conductor 1057 of communication cable 1034 is mapped to its respective retainment slot 1055 of wire cap 1032. Next wire cap 1032 and communication cable 1034 is assembled to rear sled 1040 as shown in FIG. 7. This termination method is similar to the one referenced in the patent above. FIG. 8 illustrates a complete termination of field terminable RJ45 plug assembly 1020 onto twisted pair communication cable 1034.

Figure 9:
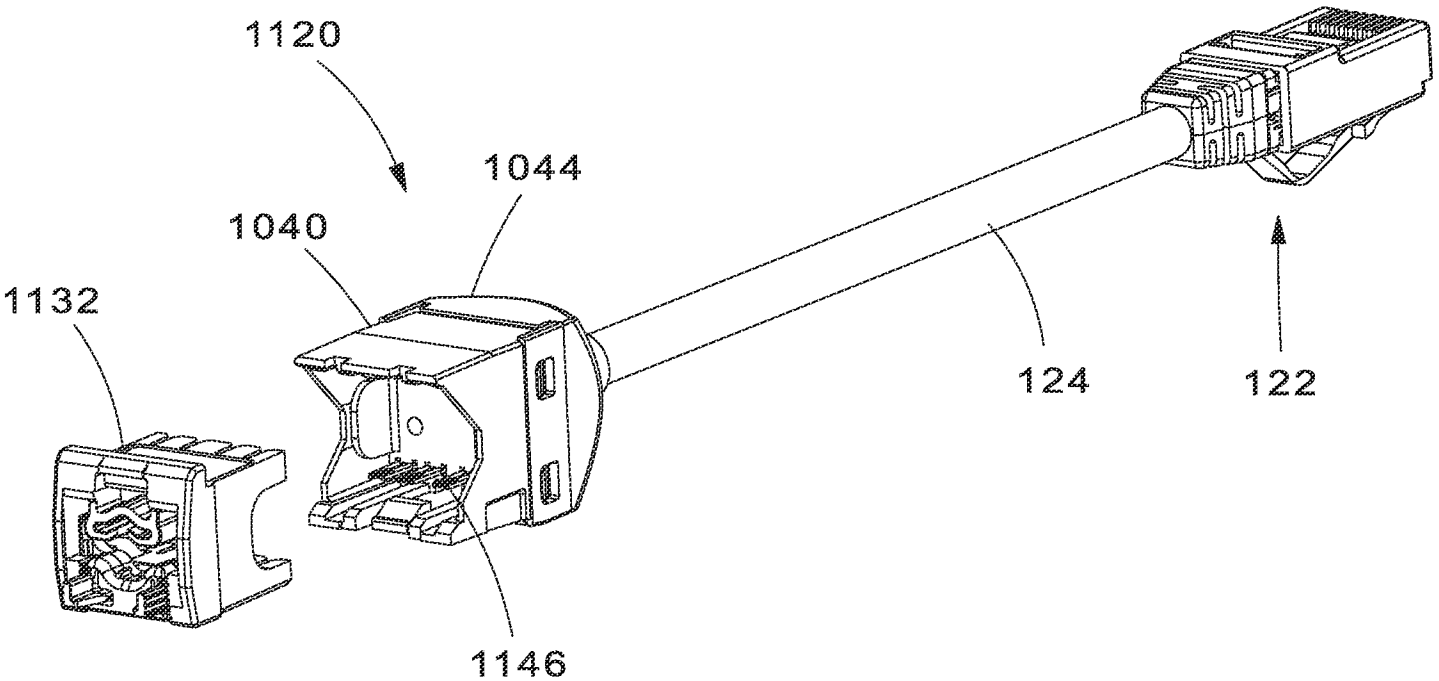
FIG. 9 is an isometric view of an alternate embodiment of a the field terminable RJ45 plug assembly of FIG. 2 using a strain relief system for smaller gauges.

Alternatively, Field terminable RJ45 plug assembly 1020 is rated to terminate to cables having conductors that range from 22 to 26 AWG. This range is dictated by wire cap 1032 and IDCs 1046. FIG. 9 shows an alternate embodiment 28-30 AWG field terminable RJ45 plug assembly 1120 that enables termination to smaller diameter cables, namely 28 and 30 AWG. 28-30 AWG IDCs 1146 and 28-30 AWG wire cap 1132 replace IDCs 1046 and wire cap 1032 in the alternate embodiment invention.

Field terminable RJ45 plug assembly 1020 can also be used for Category 5E (CAT5E) and Category 6 (CAT6). Additionally, field terminable RJ45 plug assembly 1020 could be modified for shielded applications by using a shielded plug assembly, shielded cable, and a shielded termination zone including a shielded wire cap. Furthermore, the shape of the rear sled can vary from square to round so that it can more easily fit into a ¾" conduit pipe.

Figure 10:
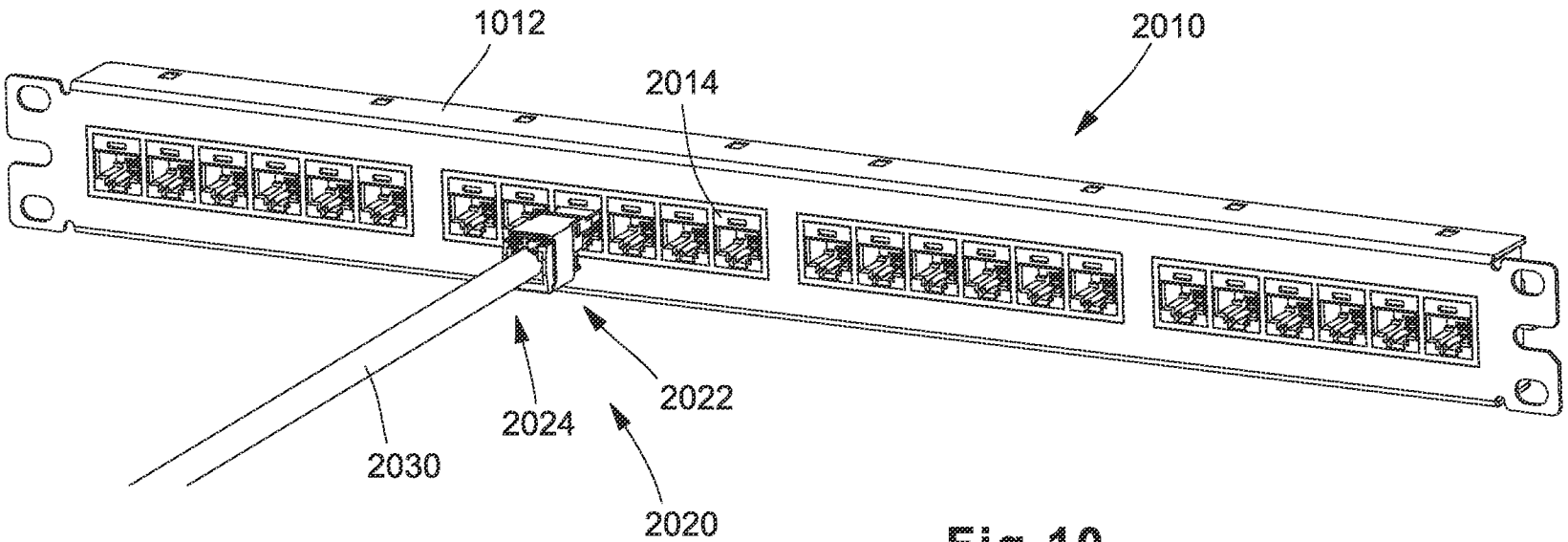
FIG. 10 is an isometric view of a communication system which includes a second embodiment of field terminable UTP RJ45 plug assembly.

FIG. 10 shows a communication system 2010 with a patch panel 2012 (which may be, but is not limited to, a wireless access point, security camera, or AV extender) populated with RJ45 jacks 2014, a field terminable UTP RJ45 plug assembly 2020, and a twisted pair cable 2030.

Figure 11:
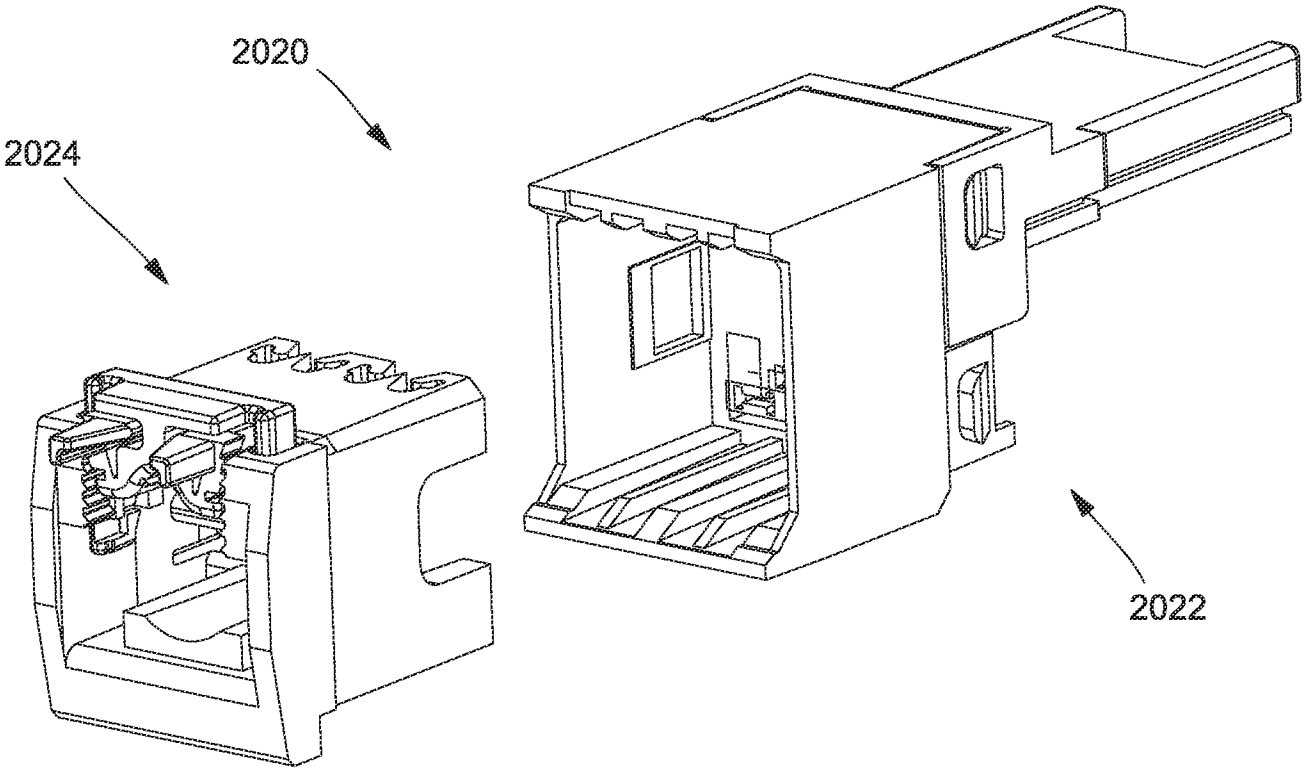
FIG. 11 is a front, top isometric view of a second embodiment of a field terminable plug assembly.

FIG. 11 shows a front, top isometric view of the field terminable plug assembly 2020 prior to being terminated onto the twisted pair cable 2030. The field terminable plug assembly 2020 includes a termination zone 2024 (which is similar to that of U.S. Pat. No. 8,287,317, which is herein incorporated by reference in its entirety) and a front plug assembly 2022.

Figure 12:
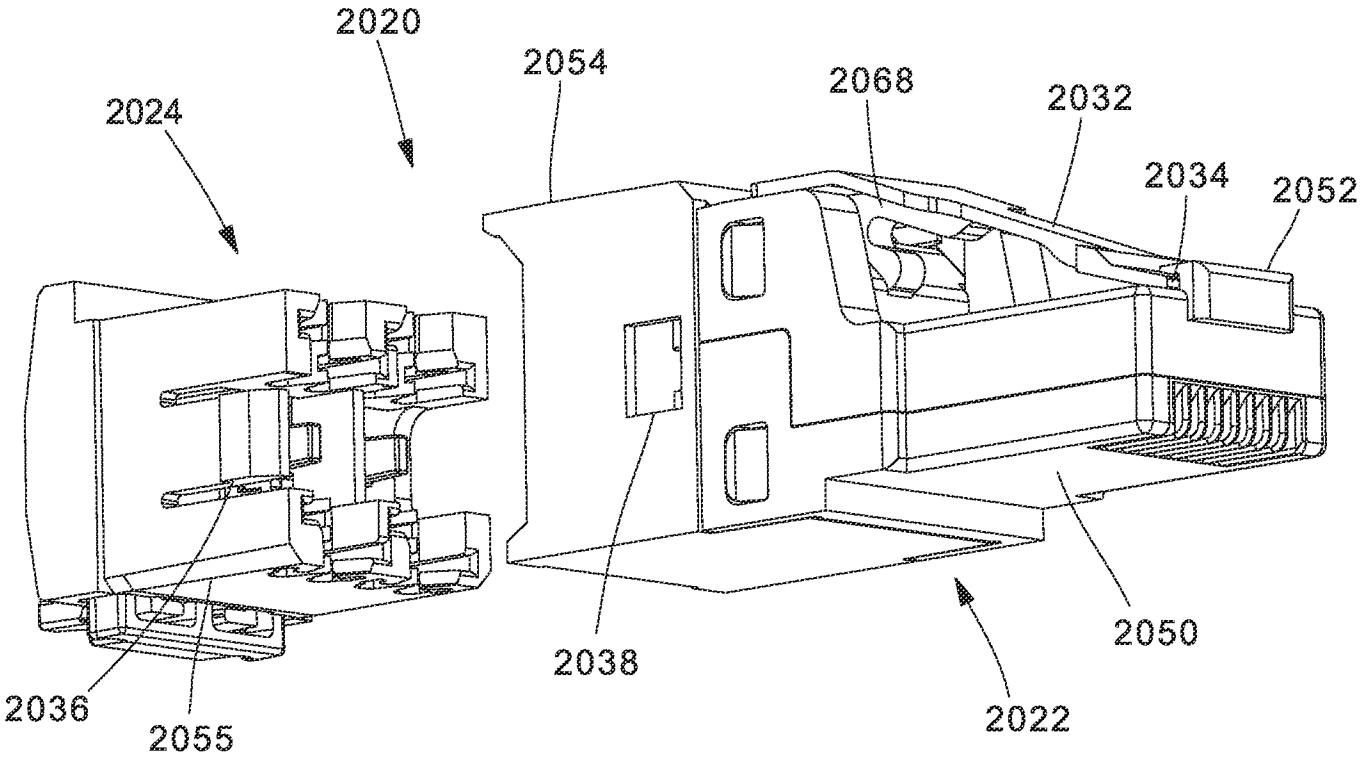
FIG. 12 is a bottom isometric view of the field terminable plug assembly of FIG. 11.

FIG. 12 shows a bottom isometric view of the field terminable plug assembly 2020. The termination zone 2024 can include a wire cap 2055 and strain relief clip 2056 (shown in FIG. 13). The front plug assembly 2022 includes a rear plug housing 2054, an upper front plug housing 2050, a lower front plug housing 2052, and an electrical cartridge assembly 2026 (shown in FIG. 13). A wire cap locking lever 2036 on the wire cap 2055 and a wire cap locking window 2038 on the rear plug housing 2054 allows the front plug assembly 2022 and the cable termination zone 24 to be locked together.

Figure 13:
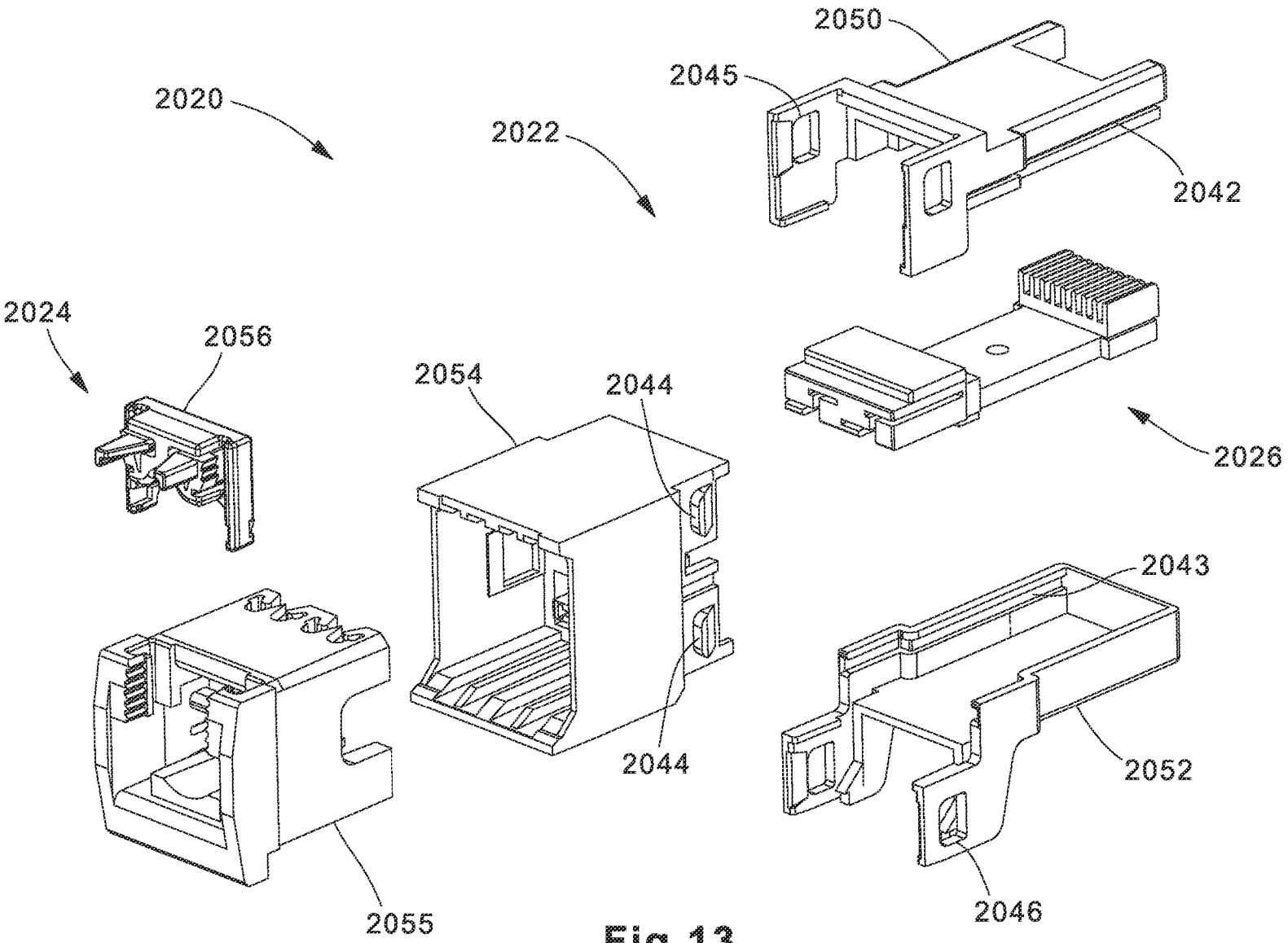
FIG. 13 is an exploded view of the field terminable plug assembly of FIG. 11.

FIG. 13 is an exploded view of the field terminable RJ45 UTP plug assembly 2020, which includes the front plug assembly 2022 and the termination zone 2024. As previously stated, the front plug assembly 2022 includes an electrical cartridge assembly 2026. The electrical cartridge assembly 2026 is enclosed by the upper front plug housing 2050 and the lower front plug housing 2052 by first engaging with the upper front plug housing 2050 and then sliding the upper front plug housing 2050 via grooves 2042 and 2043 (found on the upper front plug housing 2050 and lower front plug housing 2052, respectively) over the lower front plug housing 2052. The front plug assembly 2022 is completed by locking the rear plug housing 2054 by means of locking features 2044 of the rear plug housing 2054 and locking latches 2045 and 2046 of the upper front plug housing 2050 and lower front plug housing 2052, respectively.

Figure 14:
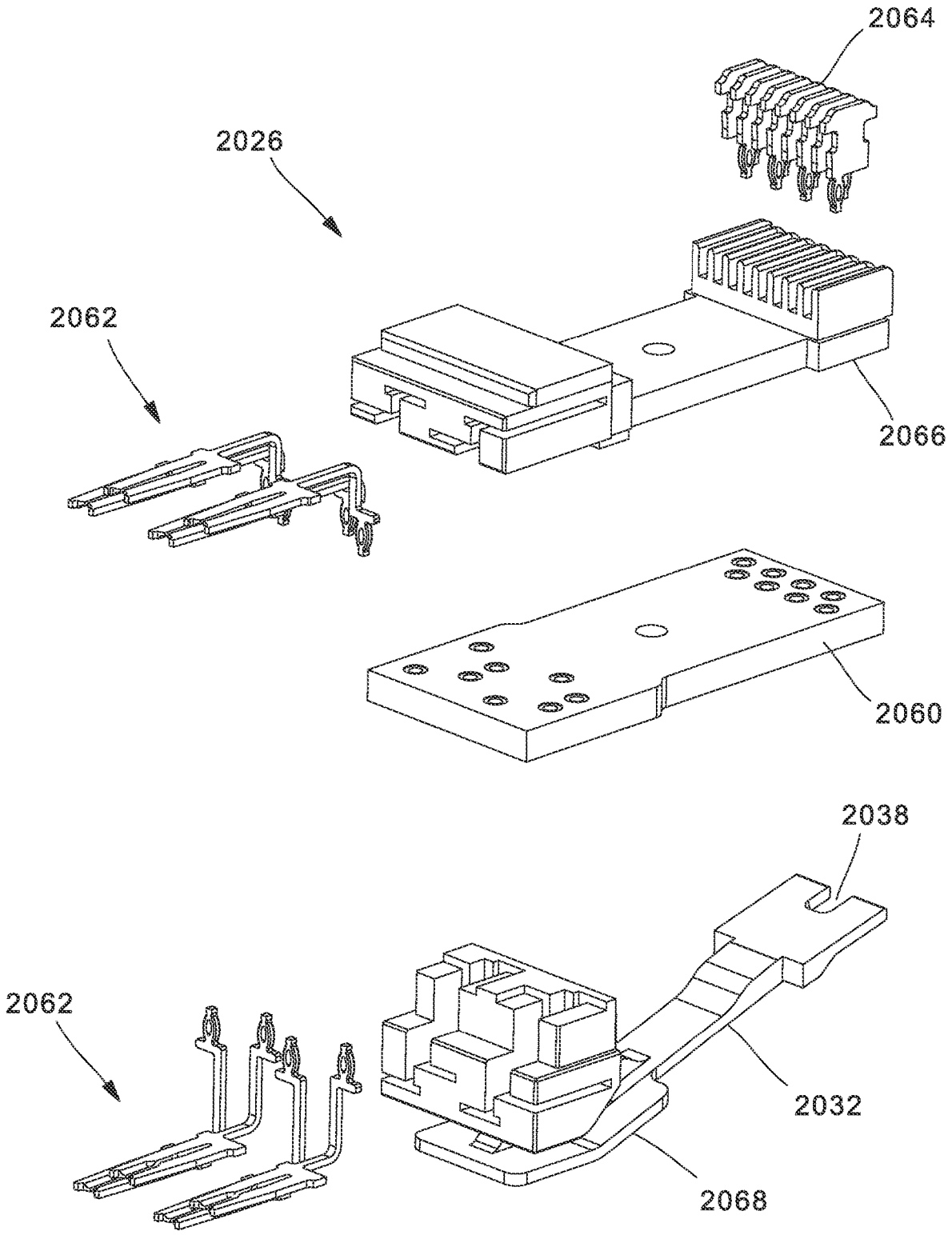
FIG. 14 is an isometric view of an electrical cartridge assembly for the field terminal plug assembly of FIG. 11.

FIG. 14 is an isometric view of the electrical cartridge assembly 2026. The electrical cartridge assembly 2026 includes a printed circuit board (PCB) 60, insulation displacing contacts (IDCs) 2062, plug contacts 2064, an upper contact support 2066, and a lower contact support 2068. The plug contacts all have the same profile but are arranged such that each contact is rotated 180 degrees relative to each adjacent contact. Referring to FIGS. 12 and 14, a plug latch 2032 of the lower contact support 2068 has a notch 2038 which engages a rib (not shown) located in a groove 2034 on the lower front plug housing 2052.

Figure 15A:
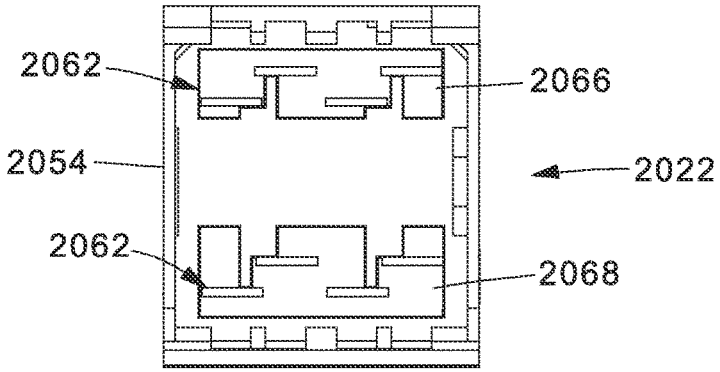
FIG. 15*a* is a rear view of the field terminable plug assembly of FIG. 11 highlighting staggered contacts.
Figure 15B:
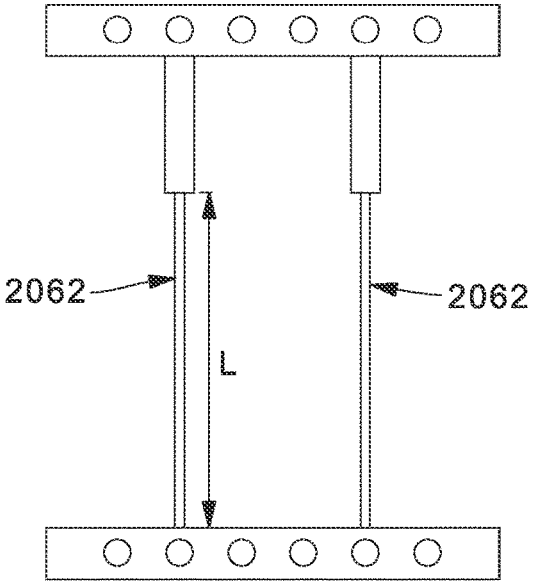
FIG. 15*b* is a flat pattern out of a stamping die for the contacts of the field terminable plug assembly of FIG. 11.
Figure 15C:
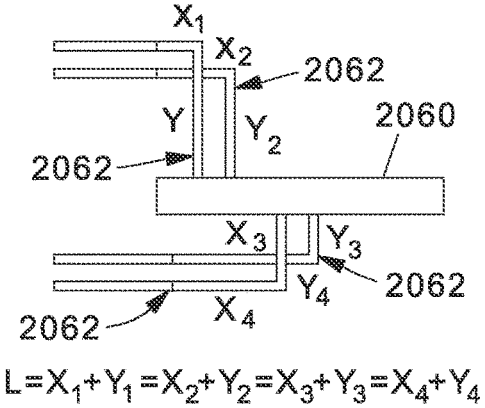
FIG. 15*c* is a side view of the PCB and contacts of the field terminable plug assembly of FIG. 11 further highlighting the staggering of the contacts.

FIG. 15*a* is a rear view of the plug assembly 2022, showing the staggered positioning of IDCs 2062 fitted into upper contact support 2066 and lower contact support 2068. FIG. 15*b* shows a flat pattern out of a stamping die for the IDCs 2062, showing a consistent lead length for all of the IDCs 2062. FIG. 15*c* shows a side view of the IDCs mounted onto the PCB 60 which further highlights that the IDCs are staggered in both a vertical and horizontal manner such that a total lead length (L) which is comprised of a horizontal length ($X_n$) and a vertical length ($Y_n$) is consistent. This is further highlighted by the following equation:

$$L=X_1+Y_1=X_2+Y_2=X_3+Y_3=X_4+Y_4$$

Figure 15D:
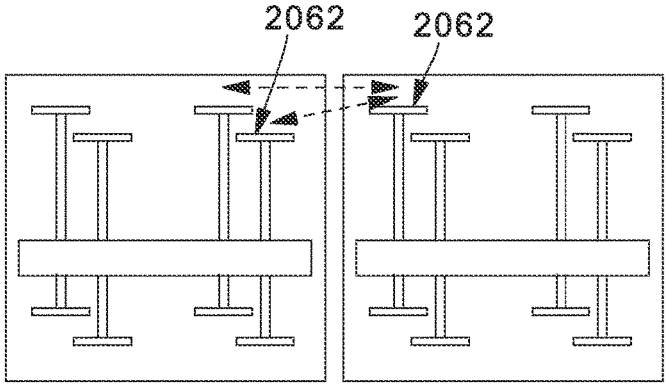
FIG. 15*d* shows the coupling of an IDC of the field terminable plug assembly of FIG. 11 to two IDCs of a neighboring plug.

The staggering of the contacts in such a manner can help create less imbalance from plug to plug (see FIG. 15*d* which shows the coupling of an IDC to two IDCs of a neighboring plug).

Figure 16:
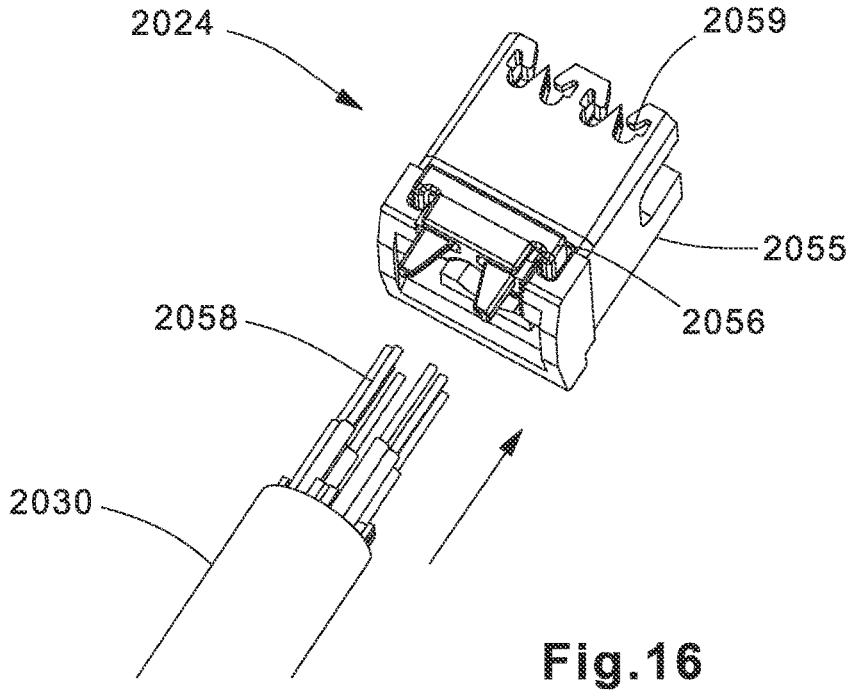
FIGS. 16-18 show the termination of a cable to the field terminable plug assembly of FIG. 11.
Figure 17:
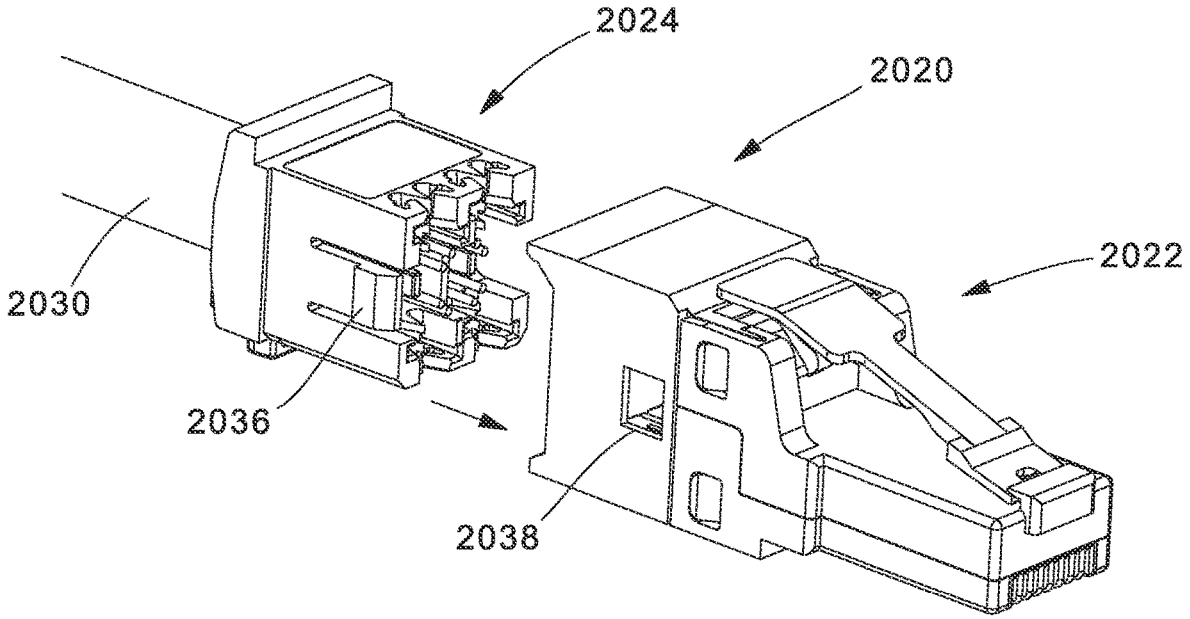
Figure 18:
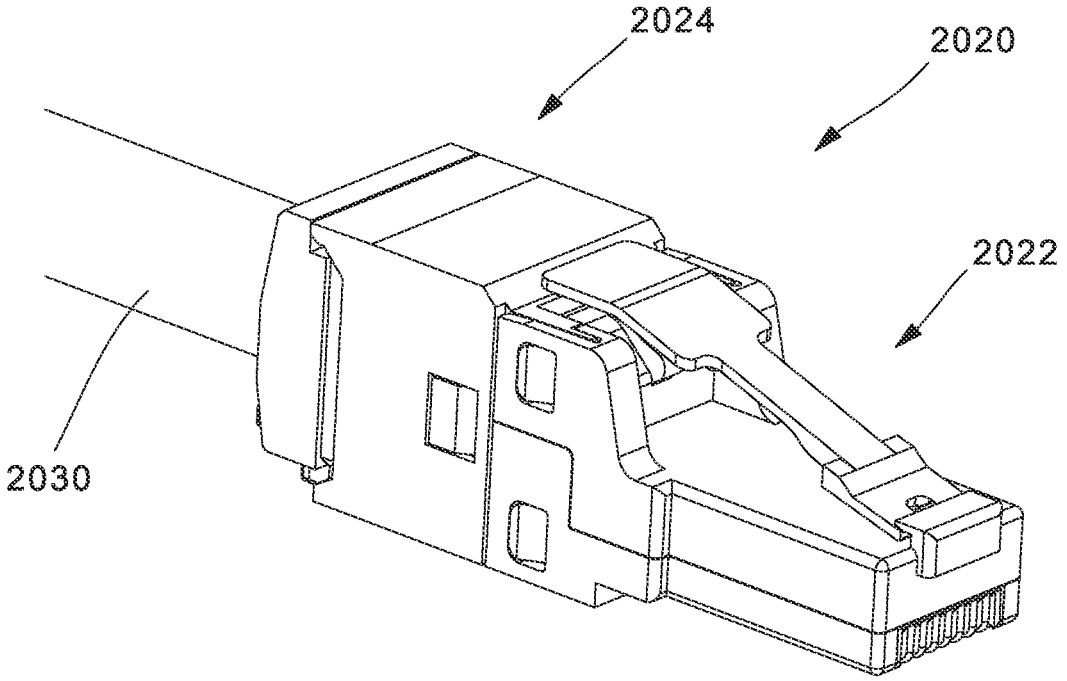

Terminating the field terminable RJ45 plug assembly 2020 begins by assembling the cable termination zone 2024, which includes the wire cap 2055 and strain relief clip 2056, onto the twisted pair cable 2030 as shown in FIG. 16. Each conductor 2058 of the twisted pair cable 2030 is mapped to its respective retainment slot 2059 of the wire cap 2055. Next, the cable termination zone 2024 and the twisted pair cable 2030 is assembled to the rear plug housing 2054 as shown in FIG. 17. FIG. 18 illustrates a complete termination of the field terminable RJ45 plug assembly 2020 onto the twisted pair cable 2030.

The field terminable RJ45 plug assembly 2020 is designed to terminate to cables having conductors that range from 22 to 26 AWG. This range is dictated by the wire cap 2055 and IDCs 2062. Modifications to the wire cap 2055 and IDCs 2062 would enable termination to smaller diameter conductors, namely 28 and 30 AWG.

The field terminable RJ45 plug assembly 2020 can also be used for Category 5E (CAT5E) and Category 6 (CAT6) rated cables. Additionally, the field terminable RJ45 plug assembly 2020 could be modified for shielded applications by using a shielded plug assembly, shielded cable, and a shielded termination zone including a shielded wire cap. Furthermore, the shape of the rear plug housing can vary from square to round so that it can more easily fit into a ¾" conduit pipe.

Figure 19:
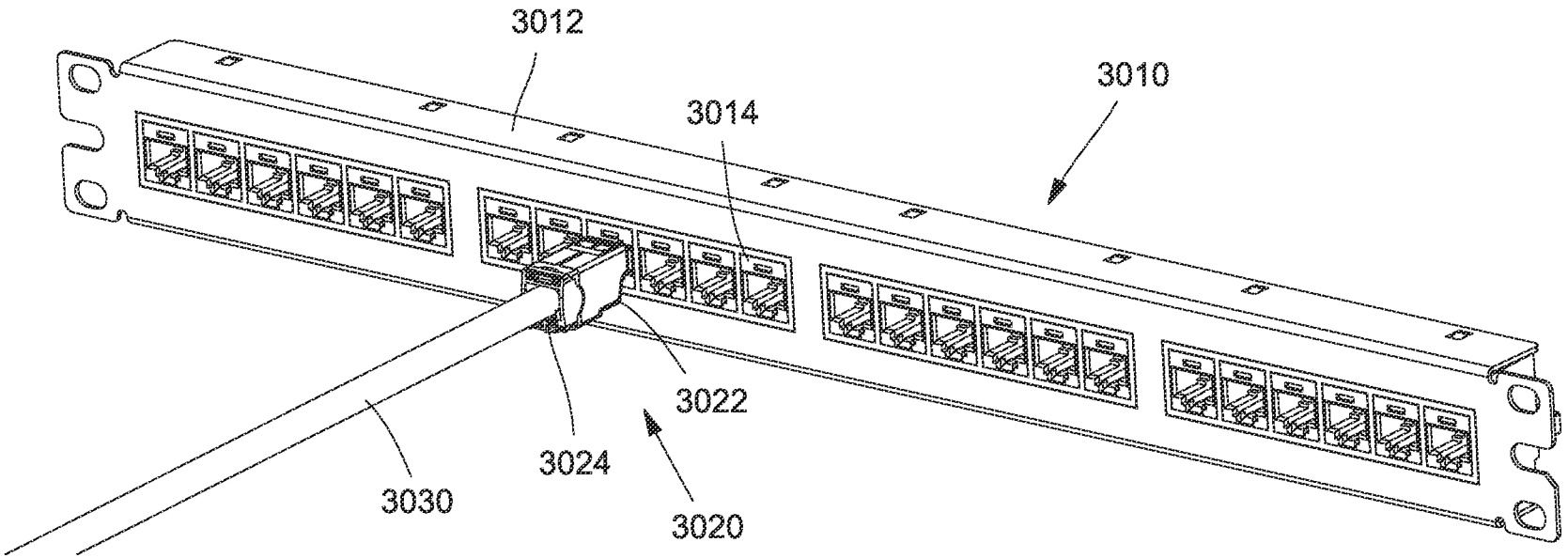
FIG. 19 is an isometric view of a communication system which includes a third embodiment of a field terminable UTP RJ45 plug assembly.

FIG. 19 shows communication system 3010 with patch panel 3012 (which may be, but is not limited to, a wireless access point, security camera, or AV extender) populated with RJ45 jacks 3014, field terminable UTP RJ45 plug assembly 3020, and twisted pair cable 3030.

Figure 20:
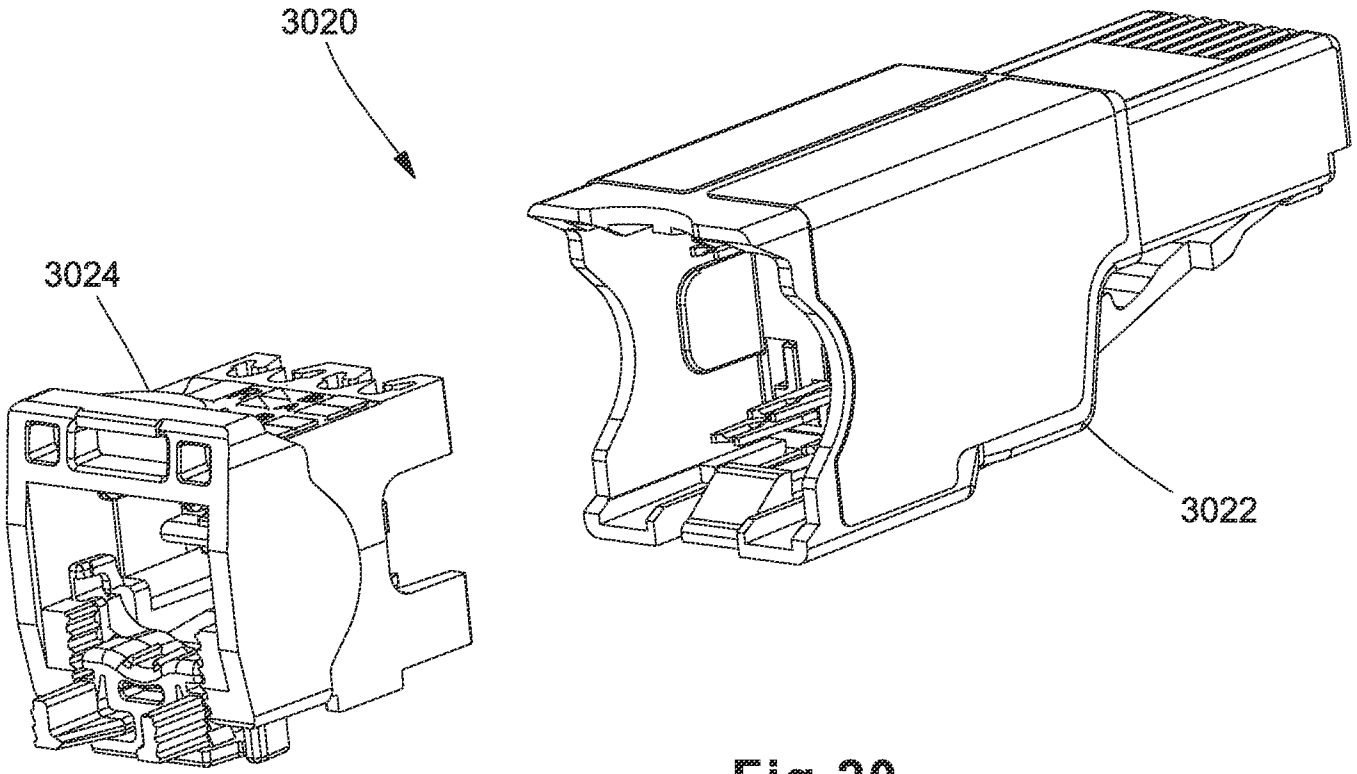
FIG. 20 is a front, top isometric view of a third embodiment of a field terminable plug assembly.
Figure 21:
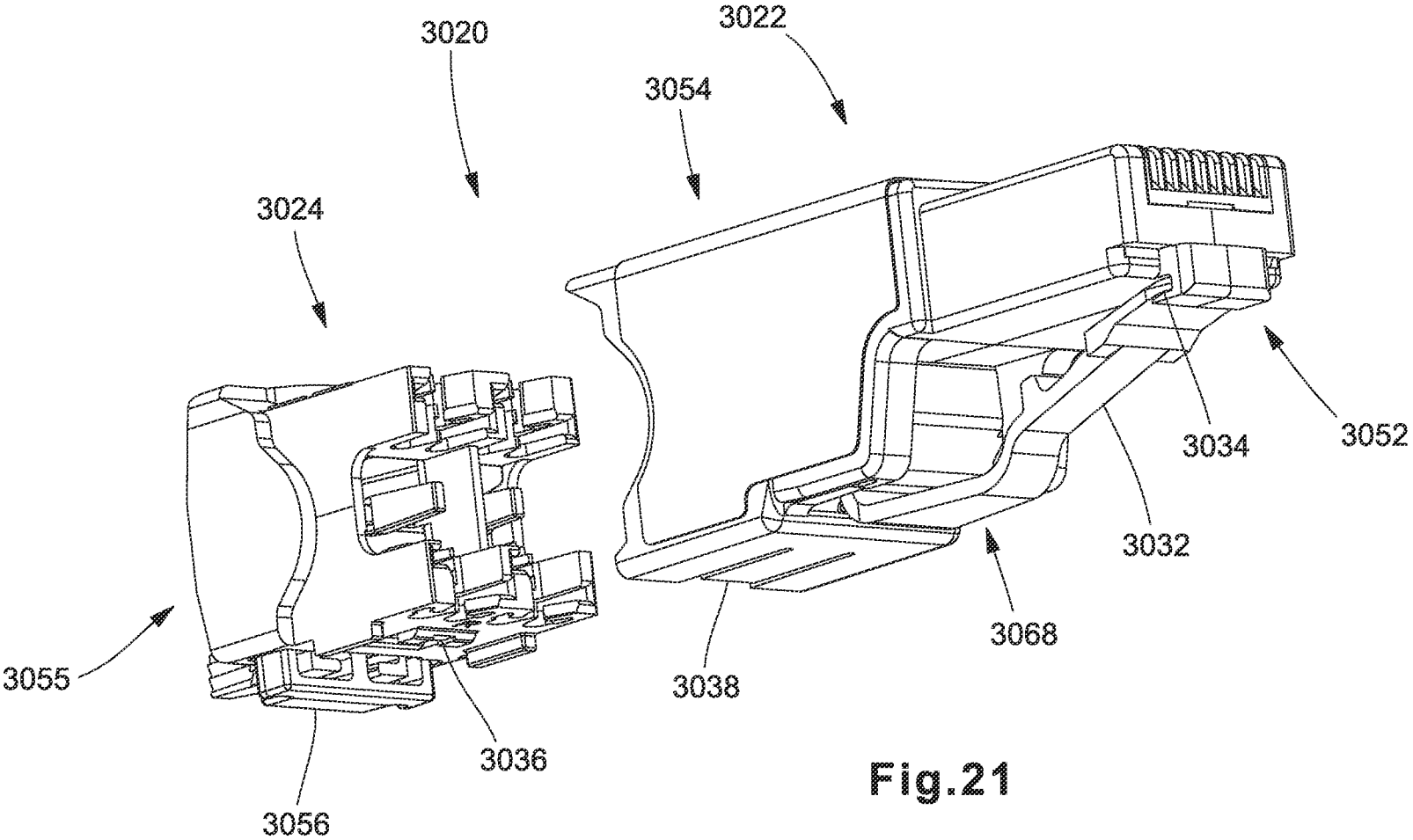
FIG. 21 is a bottom isometric view of the field terminable plug assembly of FIG. 21.

FIG. 20 shows a front top isometric view of field terminable UTP RJ45 plug assembly 3020, as a customer would receive it, prior to being terminated onto twisted pair cable 3030. FIG. 21 shows a bottom isometric view of field terminable UTP RJ45 plug assembly 3020, showing plug assembly 3022 and cable termination zone 3024 (which has similarities to that of the jack that is described in U.S. Pat. No. 8,287,317B2 (Straka et al.)). FIG. 21 also shows how plug latch 3032 of lower contact support 3068 is allowed to flex in groove 3034 of front plug housing 3052 to unlock. In addition, FIG. 21 shows wire cap locking lever 3038 of rear plug housing 3054, and wire cap locking pocket 3036 of wire cap 3055, which allows plug assembly 3022 and cable termination zone 3024 to be locked together.

Figure 22:
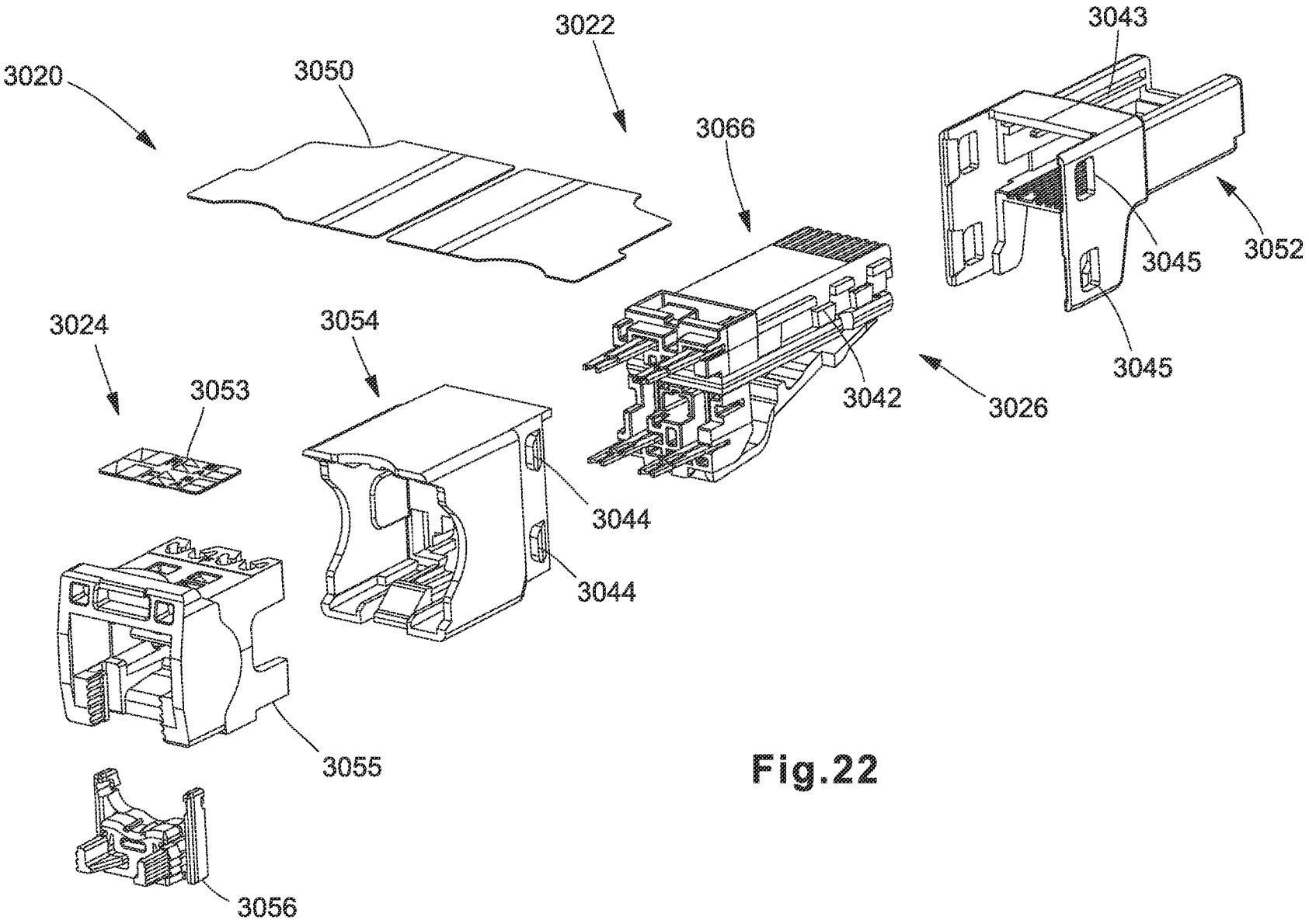
FIG. 22 is an exploded view of the field terminable plug assembly of FIG. 21.
Figure 23:
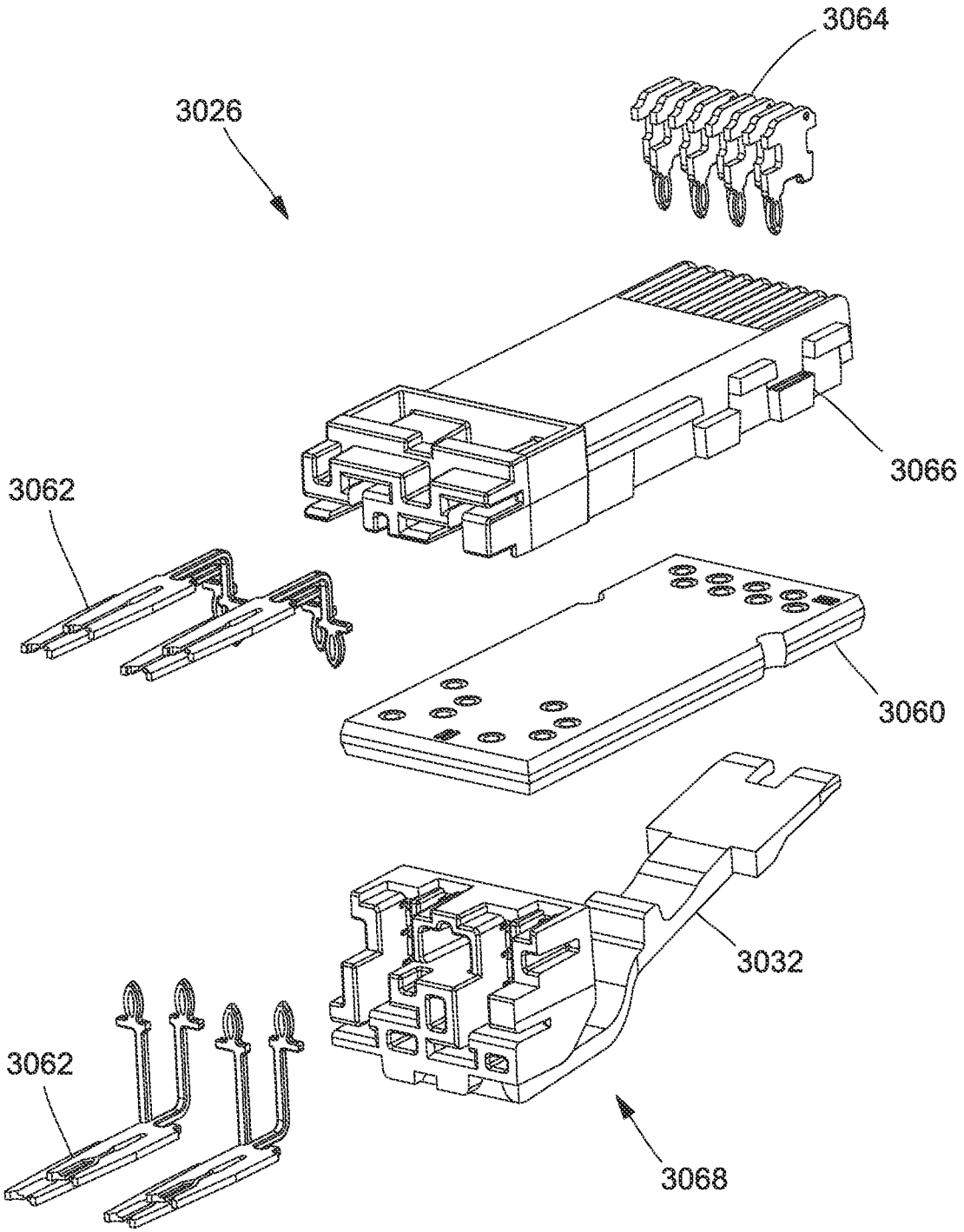
FIG. 23 is an isometric view of an electrical cartridge assembly for the field terminal plug assembly of FIG. 21.
Figure 24:
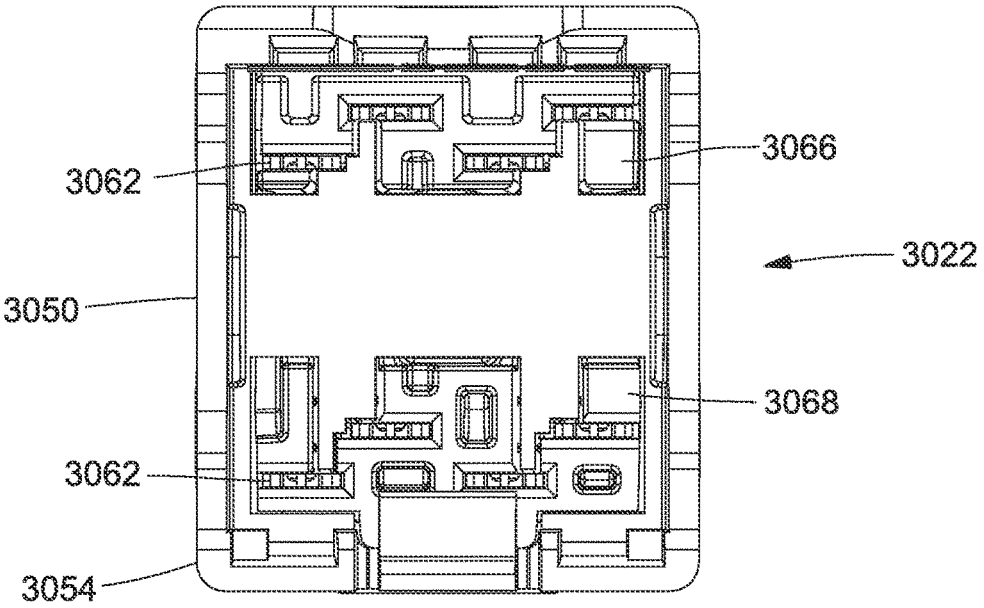
FIG. 24 is a rear view of the field terminable plug assembly of FIG. 21.

FIG. 22 is an exploded view of field terminable RJ45 UTP plug assembly 3020, which includes plug assembly 3022 and cable termination zone 3024. Plug assembly 3022 includes an electrical cartridge assembly 3026 that slides into front plug housing 3052, by means of grooves 3042 and 3043, found on the upper contact support 3066 and front plug housing 3052 respectively. Plug assembly 3022 is completed by locking rear plug housing 3054 by means of locking features 3044 of rear plug housing 3054 and locking latches 3045 front plug housing 3052 and wrapping ANEXT foil 3050. The cable termination zone 3024 includes wire cap 3055, strain relief clip 3056 and wire map label 3053. FIG. 23 is an isometric view of electrical cartridge assembly 3026, which includes printed circuit board (PCB) 3060, insulation displacing contacts (IDCs) 3062, plug contacts 3064, upper contact support 3066, and lower contact support 3068. FIG. 24 is a rear view of plug assembly 3022, which shows the staggered positioning of IDCs 3062 fitted into upper contact support 3066 and lower contact support 3068.

Figure 25:
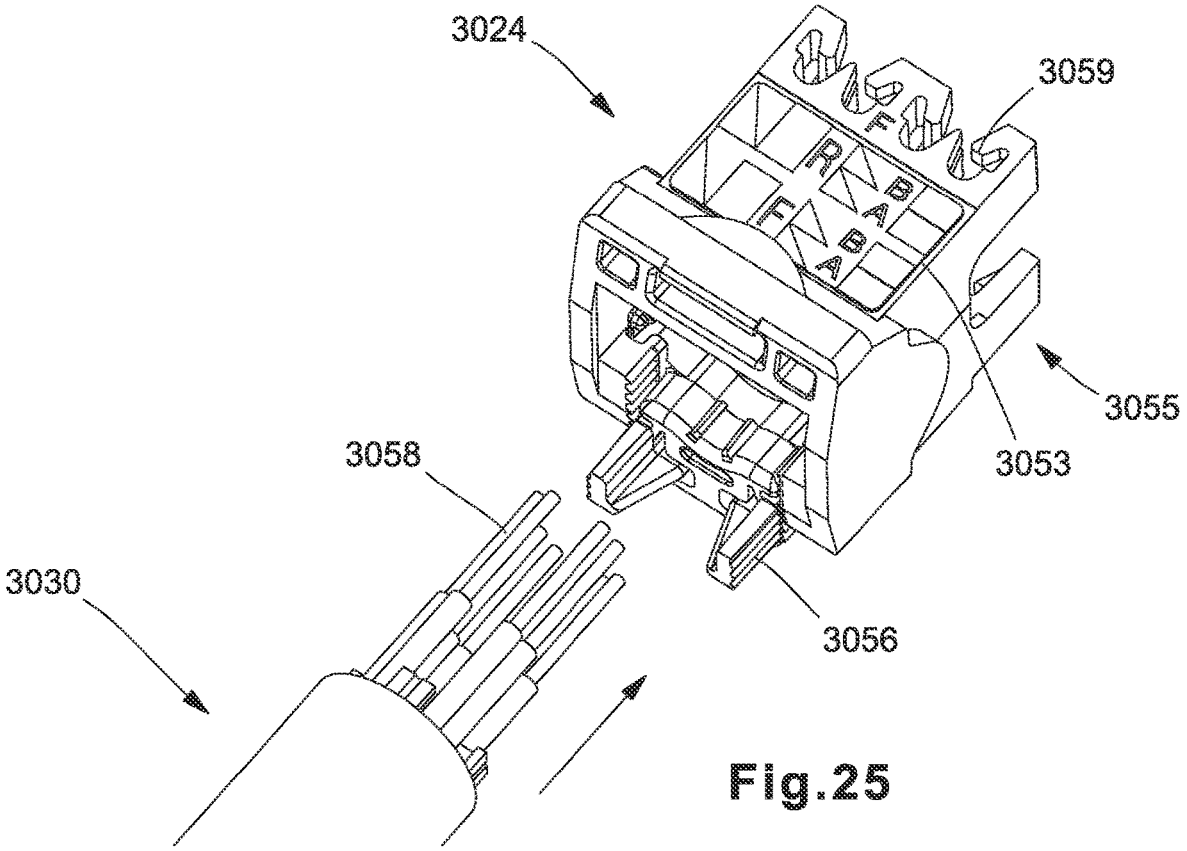
FIGS. 25-27 show the termination of a cable to the field terminable plug assembly of FIG. 21.
Figure 26:
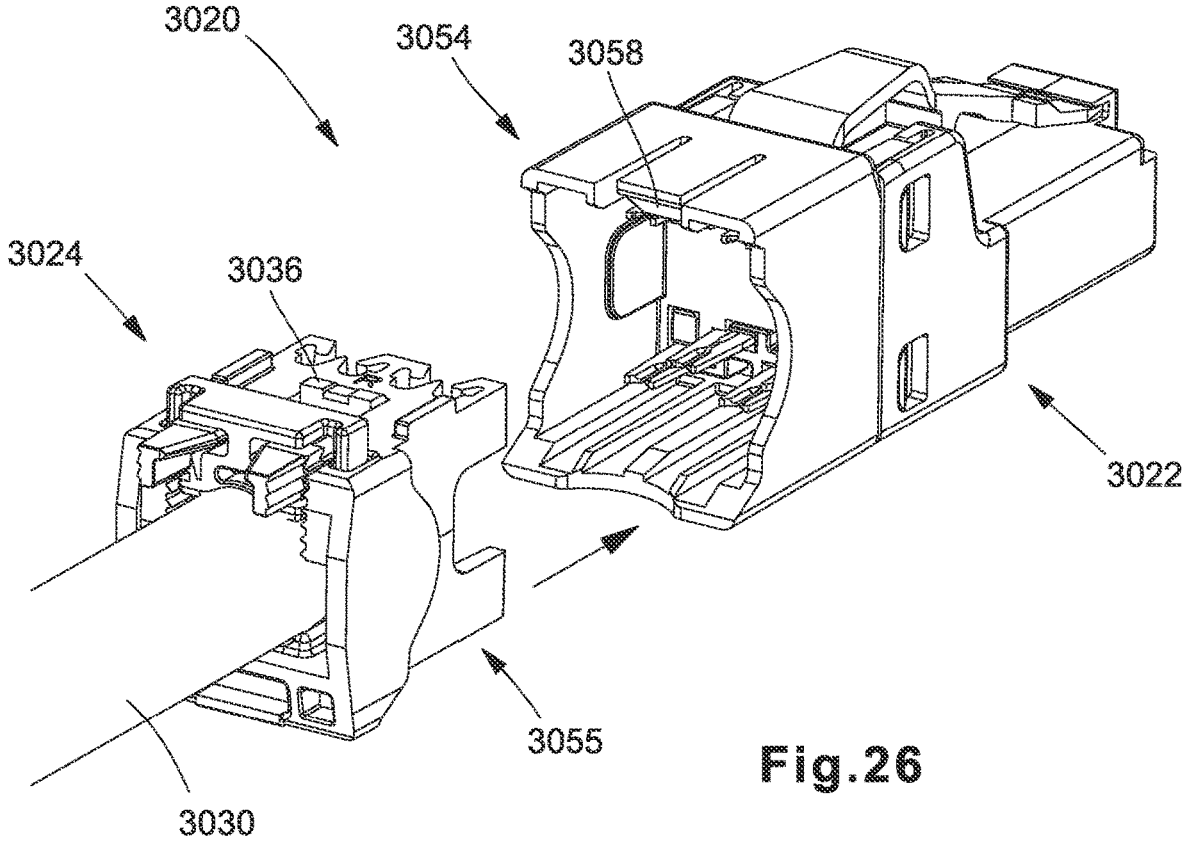
Figure 27:
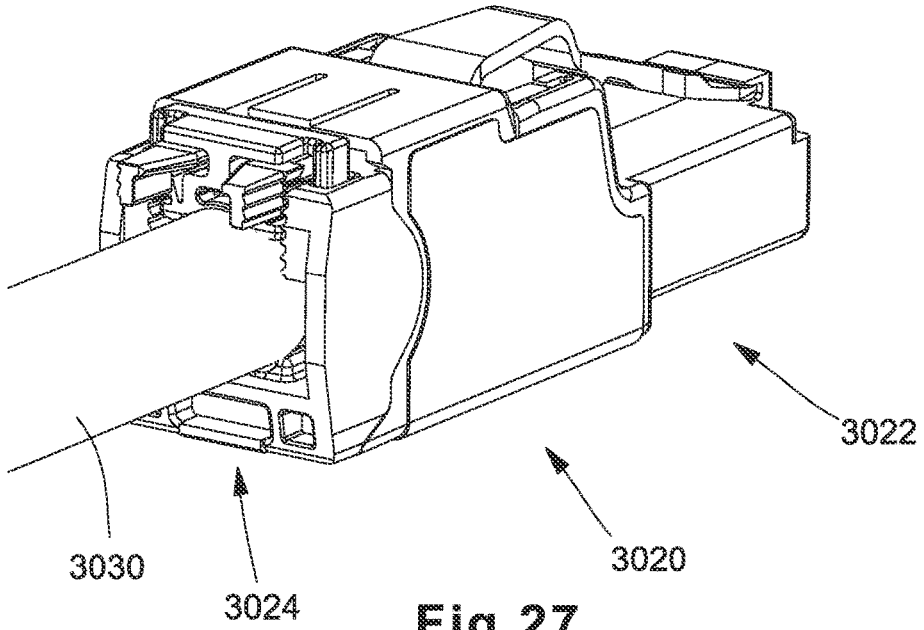

Terminating field terminable UTP RJ45 plug assembly 3020 begins by assembling cable termination zone 3024, which includes wire cap 3055 and strain relief clip 3056, onto twisted pair cable 3030 as shown in FIG. 25. Each conductor 3058 of twisted pair cable 3030 is mapped to its respective retainment slot 3059 of wire cap 3055. Next cable termination zone 3024 and twisted pair cable 3030 is assembled to rear plug housing 3054 as shown in FIG. 26. This termination method is consistent with Panduit's TG style jacks. FIG. 27 illustrates a complete termination of field terminable RJ45 plug assembly 3020 onto twisted pair cable 3030.

Field terminable UTP RJ45 plug assembly 3020 is designed to terminate to cables having conductors that range from 22-26 AWG. This range is dictated by cable termination zone 24 and IDCs 62. Modifications to wire cap 3055 and IDCs 3062 would enable termination to smaller diameter cable and conductors, namely 28-30 AWG.

Field terminable RJ45 plug assembly 3020 can also be used for Category 5E (CAT5E) and Category 6 (CAT6) rated cables. Additionally, field terminable RJ45 plug assembly 20 could be modified for shielded applications by using a shielded plug assembly, shielded cable, and a shielded termination zone including a shielded wire cap. Furthermore, the shape of the rear plug housing can vary from square to round so that it can more easily fit into a ¾" conduit pipe.

Field terminable RJ45 plug assembly 20 can be modified for the terminations of twisted pair cable 3030 in the orientations; 45° up and down vertically and left and right horizontally; and 90° up and down vertically and left and right horizontally by the modification of assembly 24.

Figure 28:
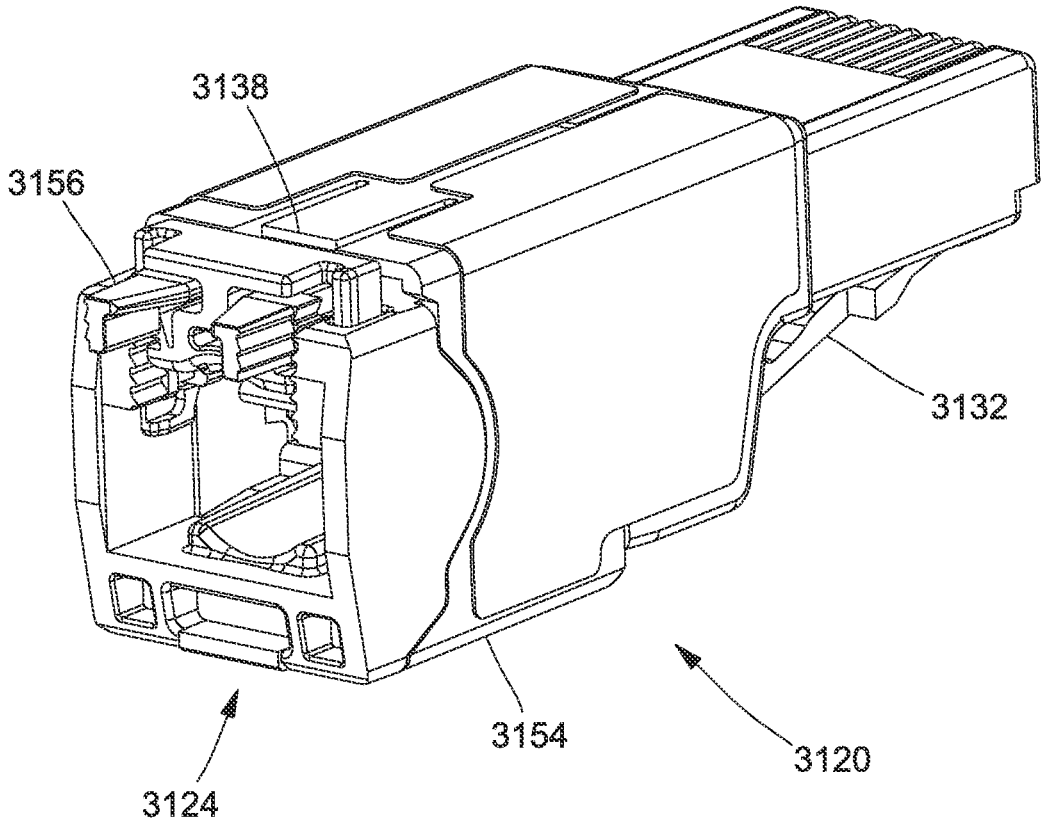
FIG. 28 is an isometric view of an alternate field terminable plug assembly to that of FIG. 21 using a different strain relief system for smaller gauges.

FIG. 28 shows the field terminable UTP RJ45 plug assembly 3120 with a flipped 180° orientation of strain relief clip 3156 of cable termination zone 3124 and wire cap locking lever 3138 which is part of rear plug housing 3154 to that of the plug latch 3132.

In some cases, this arrangement and design of cable termination zone 3024 of field terminable plug 3020 creates some unwanted coupling between some pair combinations that can negatively impact the crosstalk characteristics of the overall plug. The coupling in wire cap 3055 and IDCs 3062, in combination with the coupling in contact blades 3064 and the corresponding physical distance between them, results in crosstalk magnitude and phase characteristics that deviate beyond the optimal range of performance. To mitigate this deviation, capacitive coupling is introduced into PCB 3060 very close to IDCs 3062 to offset the unwanted coupling that naturally occurs within this termination zone 3024. As a result, the crosstalk magnitude and phase characteristics can be largely dictated by the coupling in the blade 3064 region of the plug and stay within the proper performance range for each pair combination.

Figure 29:
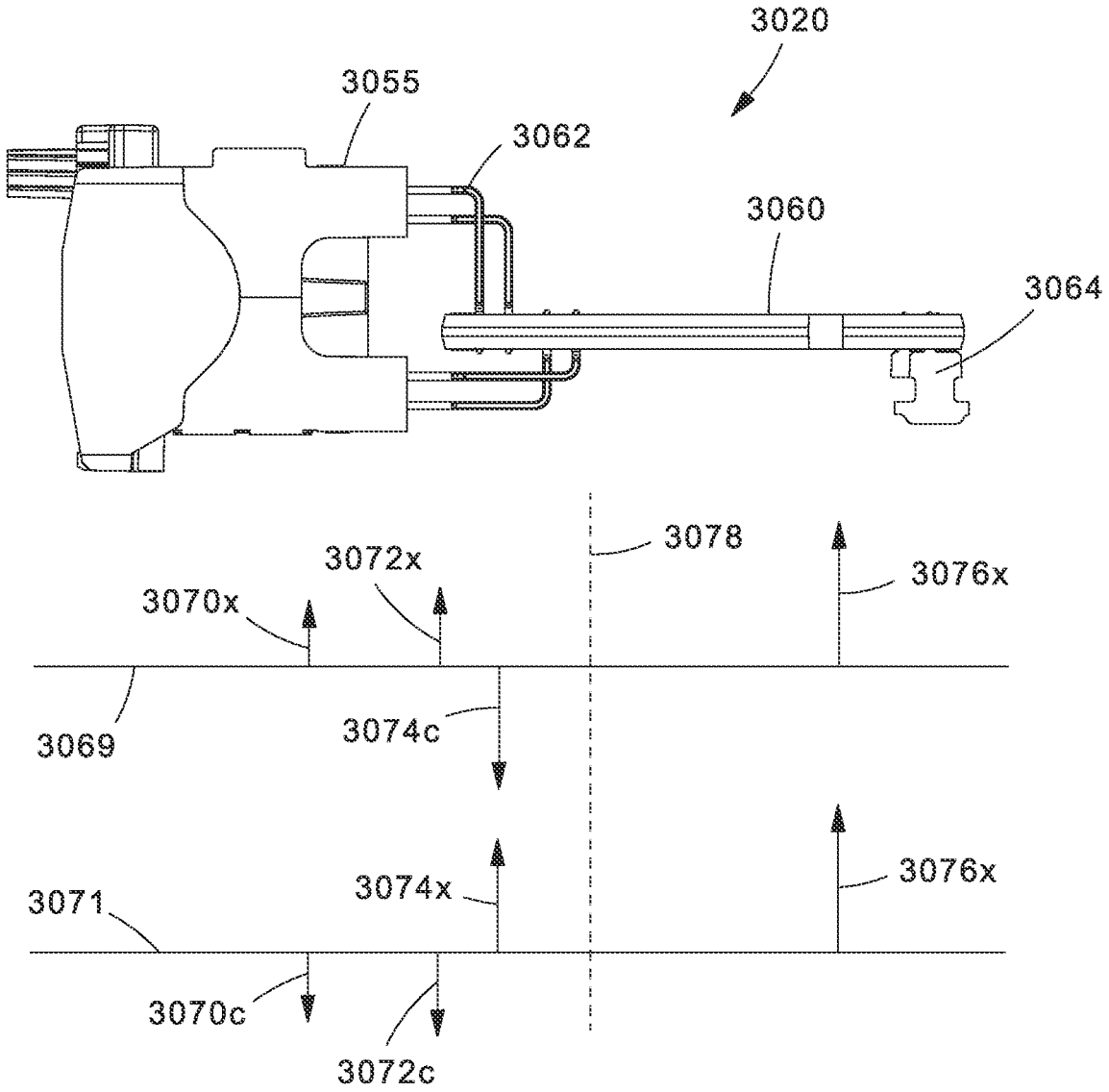
FIG. 29 shows a side profile of the field terminable plug assembly of FIG. 21 with all non-signal carrying components removed for clarity including corresponding vector diagrams.

FIG. 29 shows a side profile of field terminable plug 3020 with all non signal carrying components removed for clarity. Below is shown generic vector diagrams 3069,3071 where sources of differential pair-to-pair electromagnetic coupling in regions of plug 3020 are represented graphically as vectors. Vector 3070 represents coupling of conductors inside of wire cap 3055. Vector 3072 represents coupling of IDCs 3062. Vector 3074 represents compensative elements on PCB 3060 that are present to cancel out or mitigate the cumulative crosstalk in wire cap 3055 and IDCs 3062. In other words, vector 3074 ideally cancels out the sum of vector 3070 and vector 3072. Dashed line 3078 is shown to help identify the back of plug 3020 and the front of plug 3020. The left of dashed line 3078 is the back of plug 3020. There should be negligible levels of crosstalk in the back of plug 3020. So, it is important that vector 3074 is effective in canceling out vector 3070 and vector 3072. Vector 3076 represents the necessary pair-to-pair coupling that is required for plug 3020 to comply with crosstalk magnitude requirements as defined in ANSI/TIA-568-C.2. Crosstalk in the back of plug 3020 (to the left of dashed line 3078) may or may not be of the same polarity as the crosstalk requirements of ANSI/TIA-568-C.2. Some pair combinations may have crosstalk of the same polarity, others opposite. Vector diagram 69 shows crosstalk in wire cap 3055 (vector $\mathbf{3070}_X$) and crosstalk in IDCs (vector $\mathbf{3072}_X$) has the same polarity as the required crosstalk (vector $\mathbf{3076}_X$). The compensative elements in PCB 3060 (vector $\mathbf{3074}_C$) would therefore have crosstalk that is opposite polarity in order to cancel out. The subscript "X" here stands for crosstalk, which here implies crosstalk that is of the same polarity as the overall plug crosstalk required for ANSI/TIA-568-C.2. The subscript "C" here stands for compensation, which is commonly referred as crosstalk that is of opposite polarity as the overall plug crosstalk required for ANSI/TIA-568-C.2. Vector diagram 3071 shows crosstalk in wire cap 3055 (vector $\mathbf{3070}_C$) and crosstalk in IDCs (vector $\mathbf{3072}_C$) has the opposite polarity as the required crosstalk (vector $\mathbf{3076}_X$). The compensative elements in PCB 3060 (vector $\mathbf{3074}_X$) would therefore have crosstalk that is the same polarity in order to cancel out. Regardless of the polarity of crosstalk in wire cap 3055 and IDCs 3062, crosstalk of opposite polarity is added to PCB 3060 in order to reduce the overall crosstalk in the back of plug 3020 to negligible levels.

Figure 30:
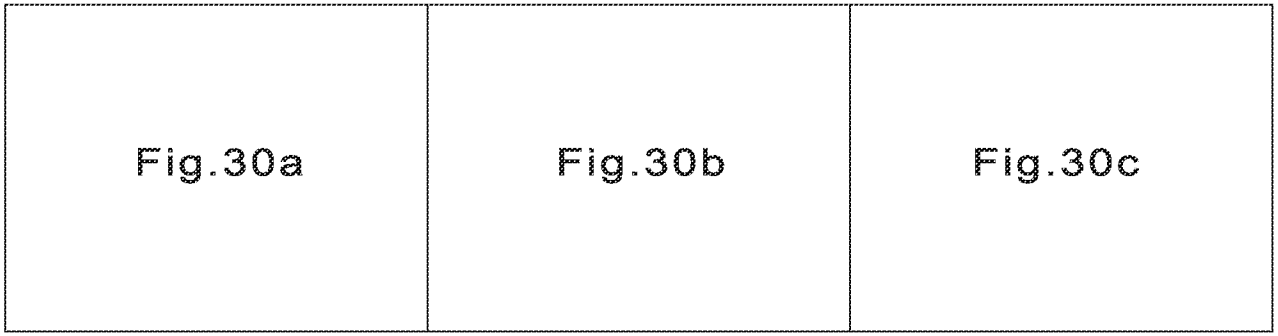
FIG. 30 is a full schematic of a Spice model of the field terminable plug assembly of FIG. 21
Figure 30A:
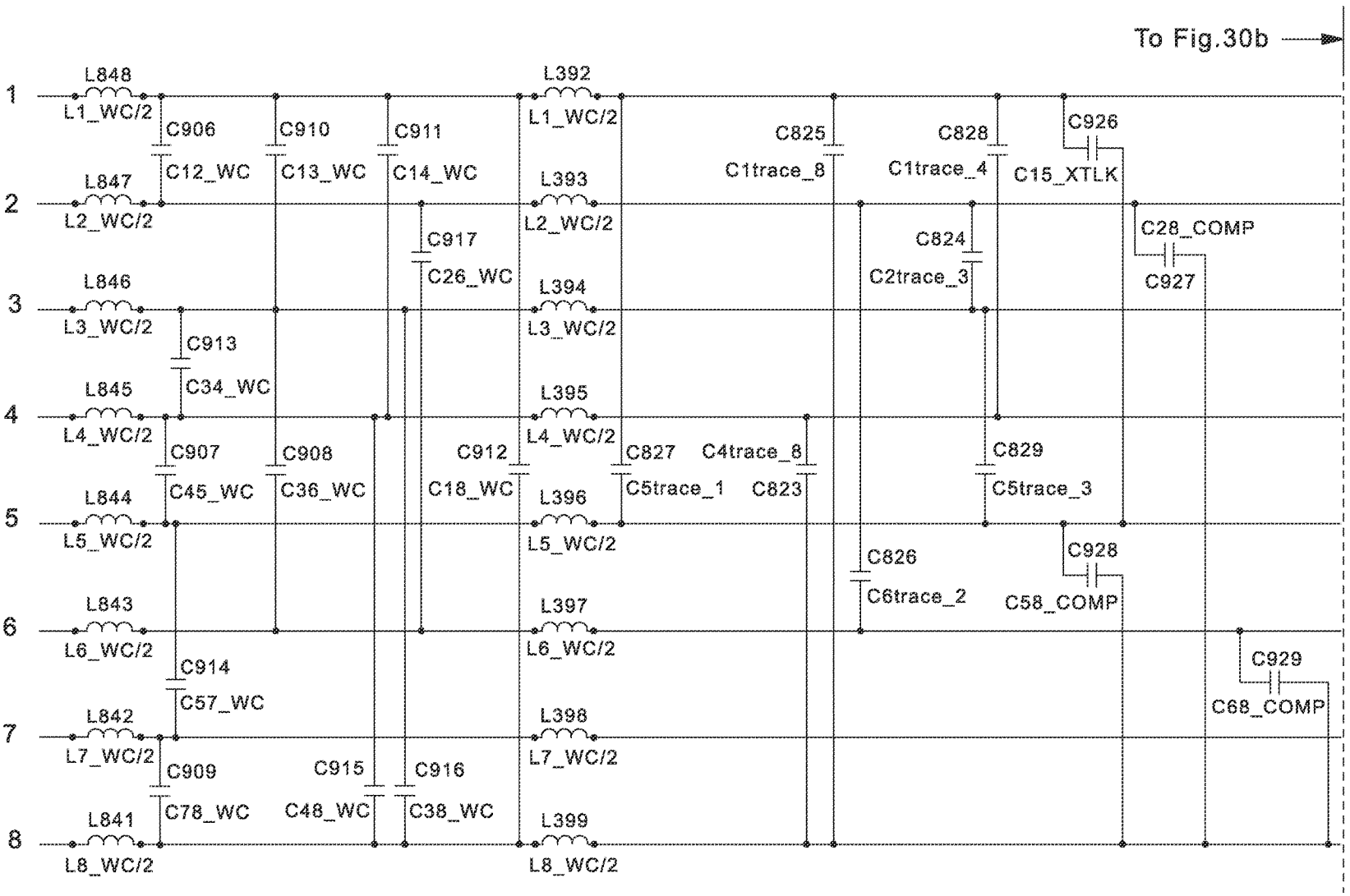
Figure 30B:
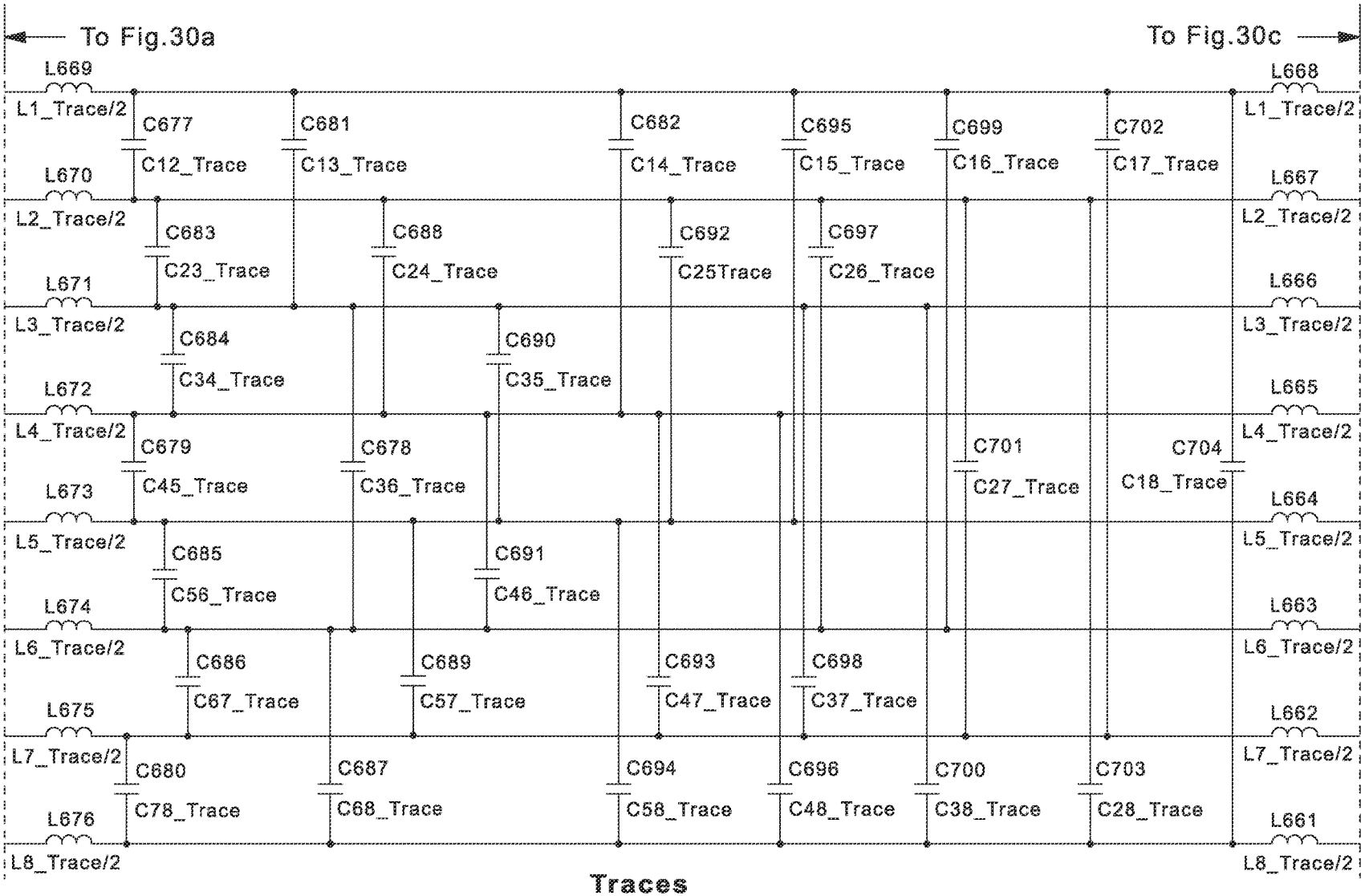
Figure 30C:
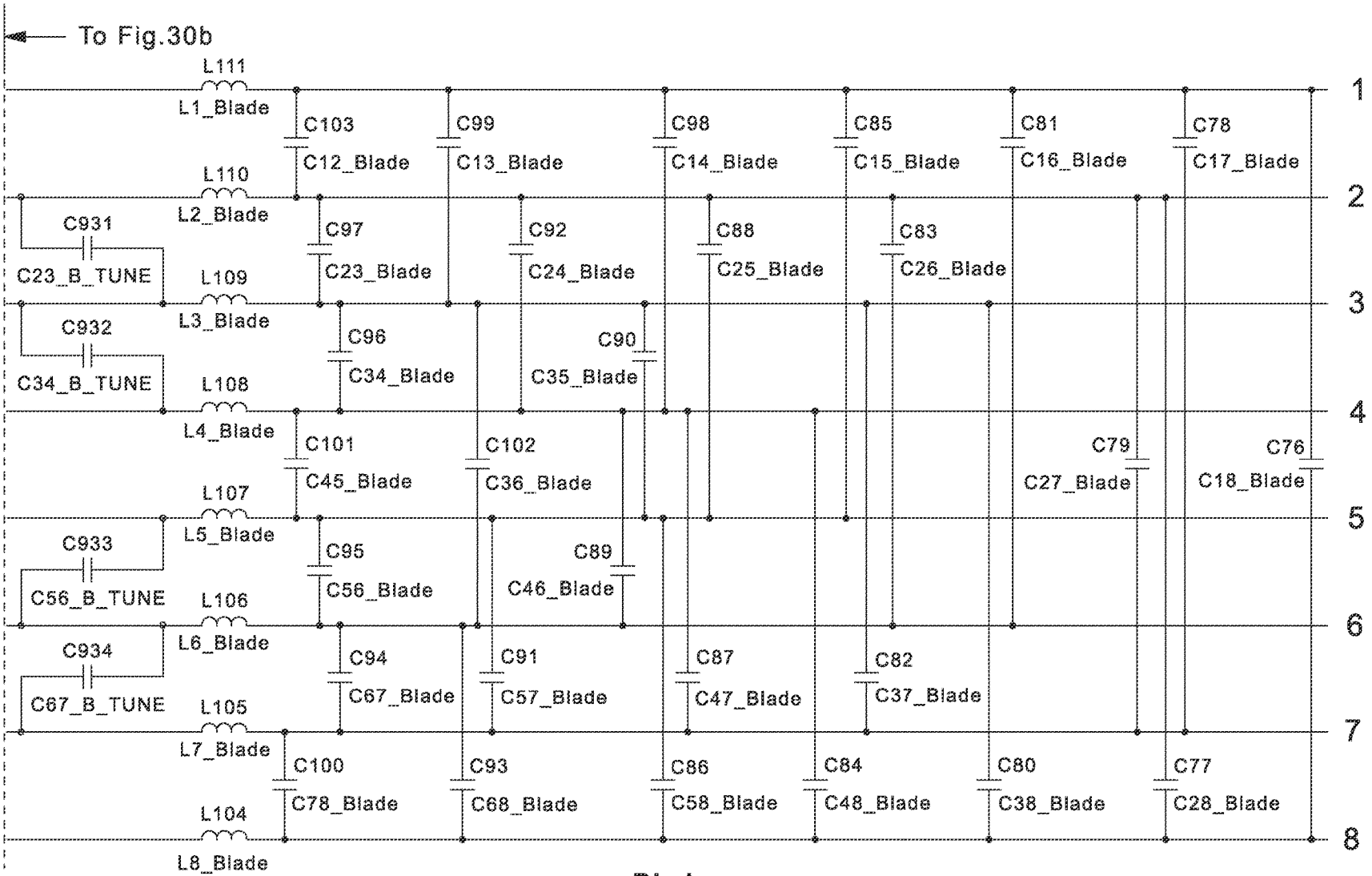

FIG. 30 is a full schematic of a Spice model of field terminable UTP RJ45 plug assembly 3020, showing simulated unintentional capacitances in each of the 3 major sections of the plug assembly. Intentional coupling is added close to the IDC vias. This reduces the unwanted crosstalk in the back of plug 3020 (IDCs 3062 and wire cap 3055 region), leaving crosstalk in the blades 3064 and near the front of plug 3020 to dictate the overall plug crosstalk characteristics. In addition, crosstalk and mutual inductance were added and adjusted respectfully to improve remaining NEXT and FEXT in the plug assembly to get the performance required. These values in the full schematic are broken down into simpler views of individual pair combinations for clarity in following figures.

Figure 31:
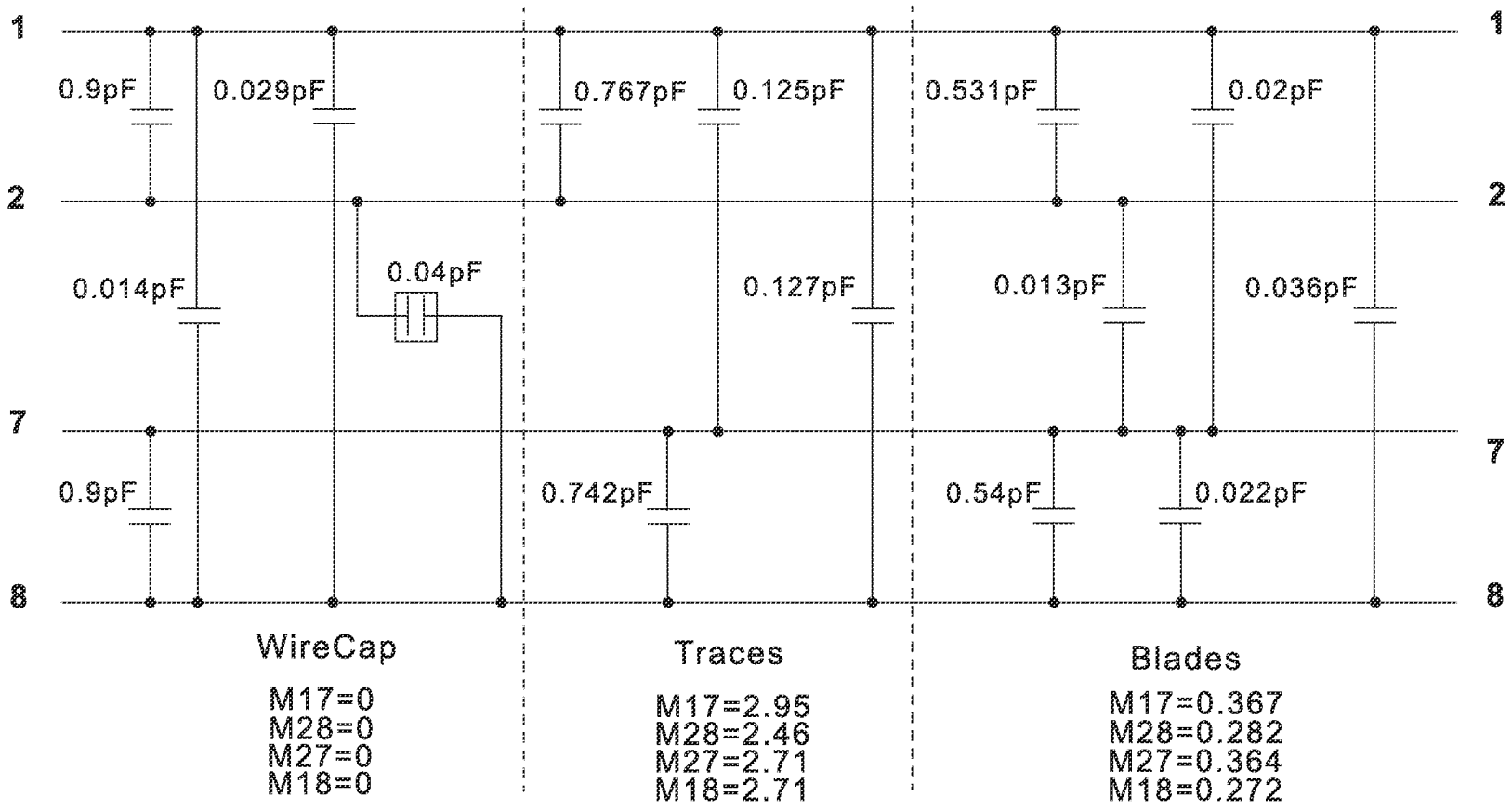
FIGS. 31-36 are simplified schematics of FIG. 30 for different pair combinations.

FIG. 31 is the simplified schematic for pair combination 12-78. Like the full schematic, the plug assembly 3020 is broken down into 3 major sections wire cap and the wires 3055, traces or PCB 3060, and blade contacts 3064. The unintentional capacitances are shown with vertical symbols, where any added capacitance elements for tuning are shown rotated 90 degrees, i.e. the 28 compensation cap of 0.04 pF is added to PCB 3060 near the plated through holes for IDCs 3062 to reduce crosstalk in the back of plug 3020. Although it is not shown explicitly, it is understood that each conductor exhibits a self inductance. The inductive coupling [0069] between these conductors is represented in the schematic by the mutual inductances shown in each major section of the schematic.

Figure 32:
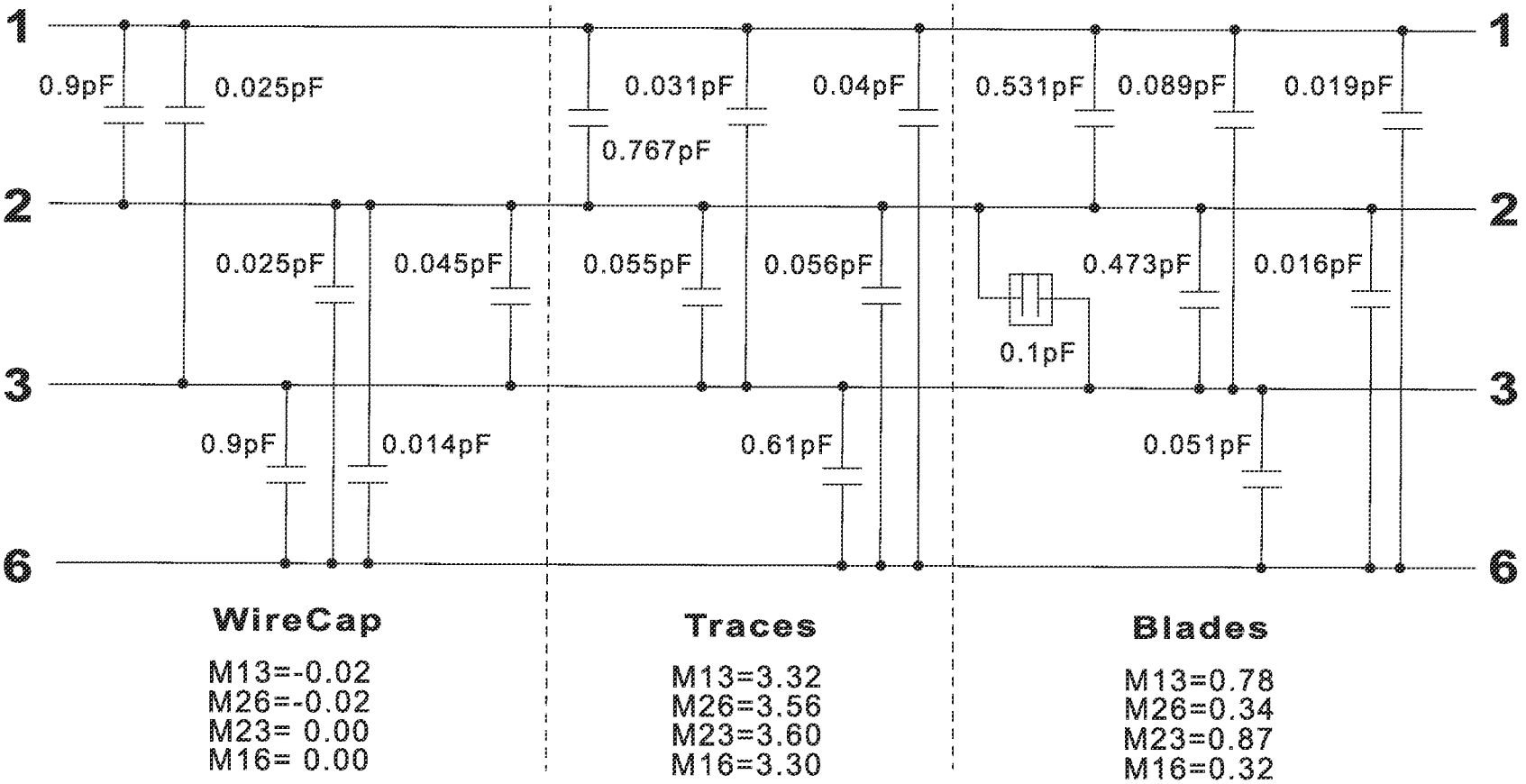

FIG. 32 is the simplified schematic for pair combination 12-36. Although it is not shown explicitly, it is understood that each conductor exhibits a self inductance. The inductive coupling between these conductors is represented in the schematic by the mutual inductances shown in each major section of the schematic. Note that no tuning elements are required to reduce the back of plug 3020 crosstalk to an acceptable level. However, a 23 crosstalk cap of 0.1 pF is added near blades 3064 in order the bring the overall 12-36 crosstalk magnitude into compliance for ANSI/TIA-568-C.2.

Figure 33:
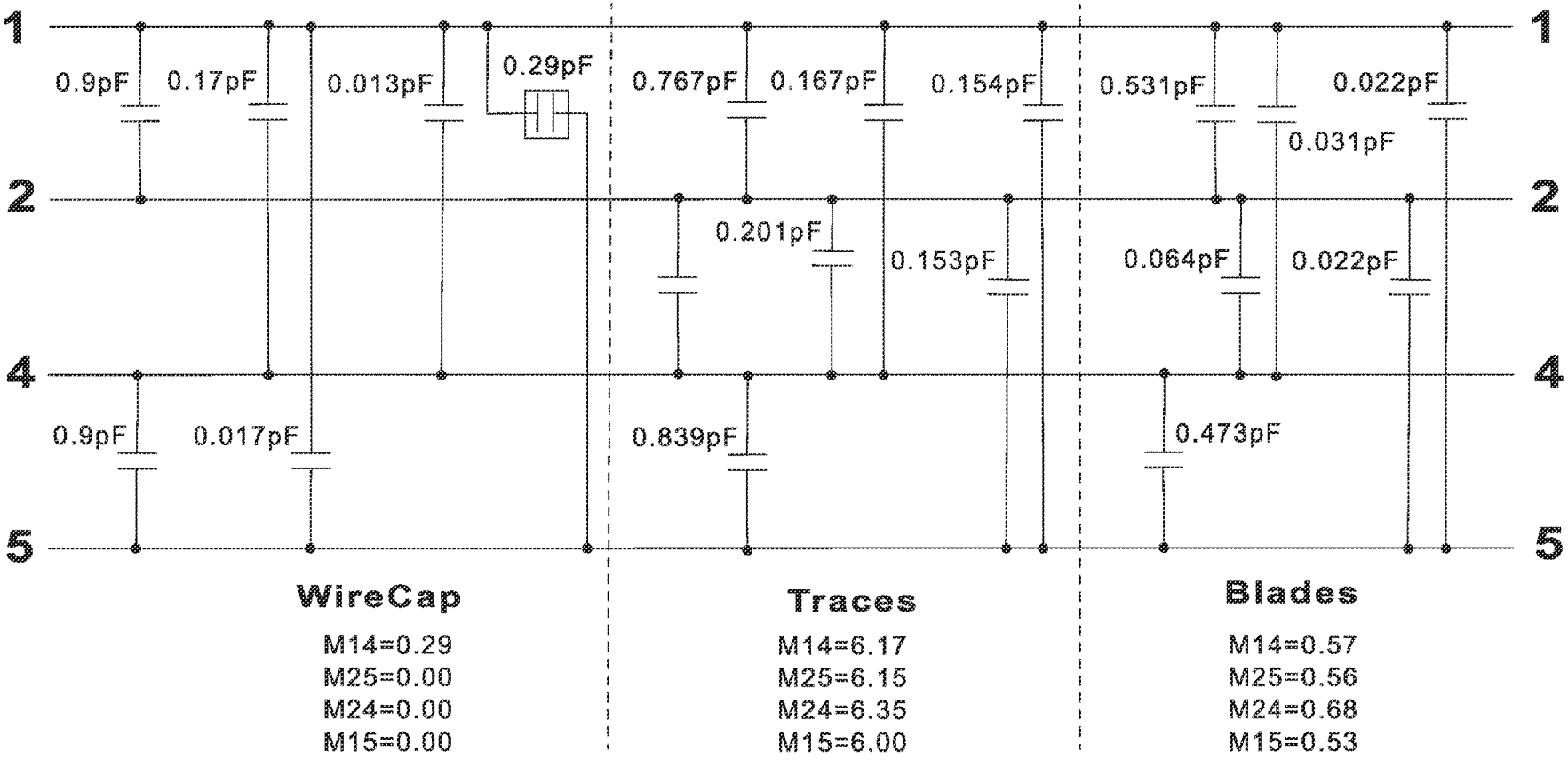

FIG. 33 is the simplified schematic for pair combination 12-45. The 15 crosstalk cap of 0.29 pF to PCB 3060 near the plated through holes for IDCs 3062 to reduce crosstalk in the back of plug 3020. Although it is not shown explicitly, it is understood that each conductor exhibits a self inductance. The inductive coupling between these conductors is represented in the schematic by the mutual inductances shown in each major section of the schematic.

Figure 34:
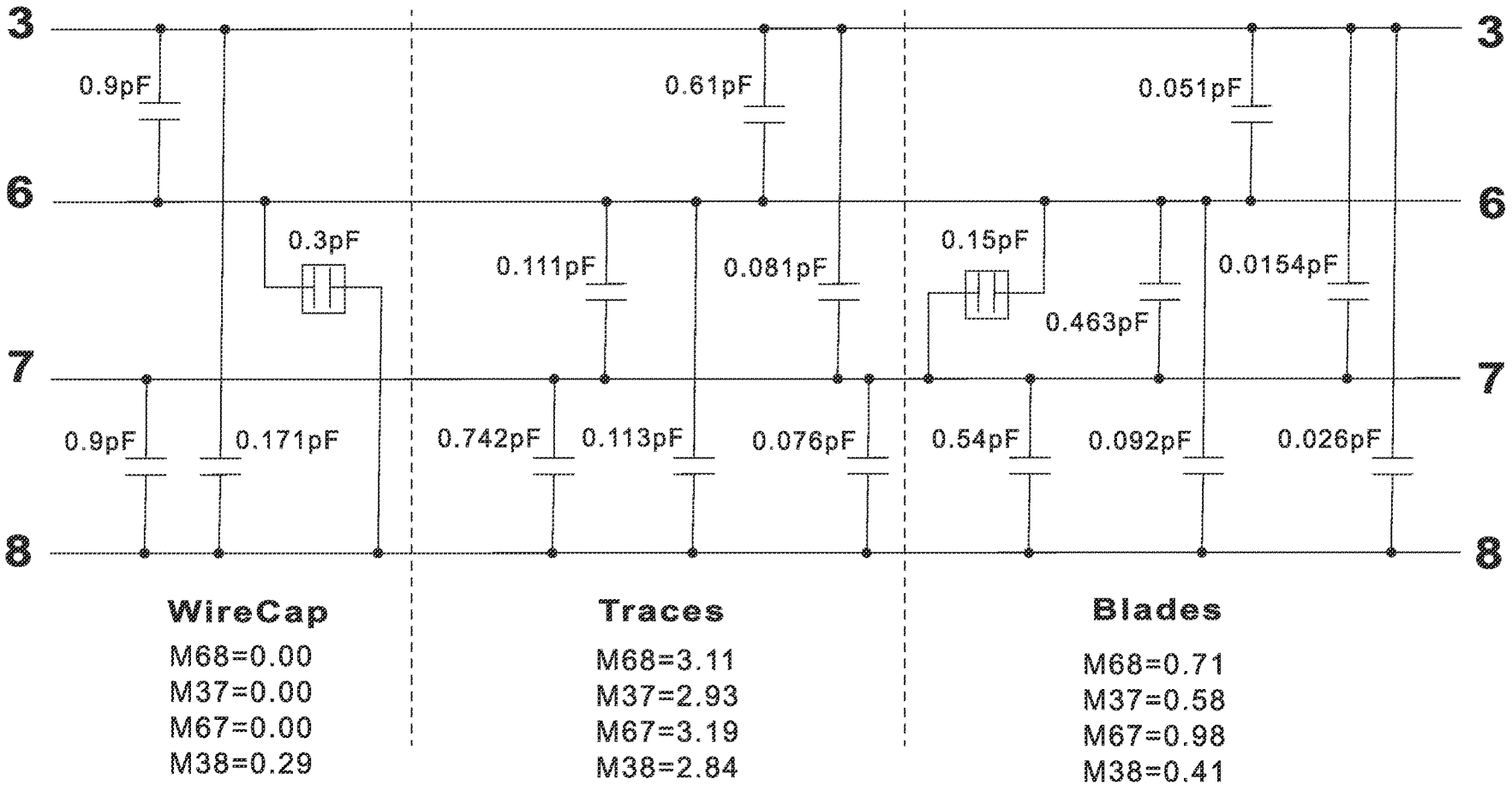

FIG. 34 is the simplified schematic for pair combination 36-78. 68 compensation cap of 0.3 pF is added to PCB 3060 near the plated through holes for IDCs 3062 to reduce crosstalk in the back of plug 3020. 67 crosstalk cap of 0.15 pF is added near blades 3064 in order the bring the overall 36-78 crosstalk magnitude into compliance. Although it is not shown explicitly, it is understood that each conductor exhibits a self inductance. The inductive coupling between these conductors is represented in the schematic by the mutual inductances shown in each major section of the schematic.

Figure 35:
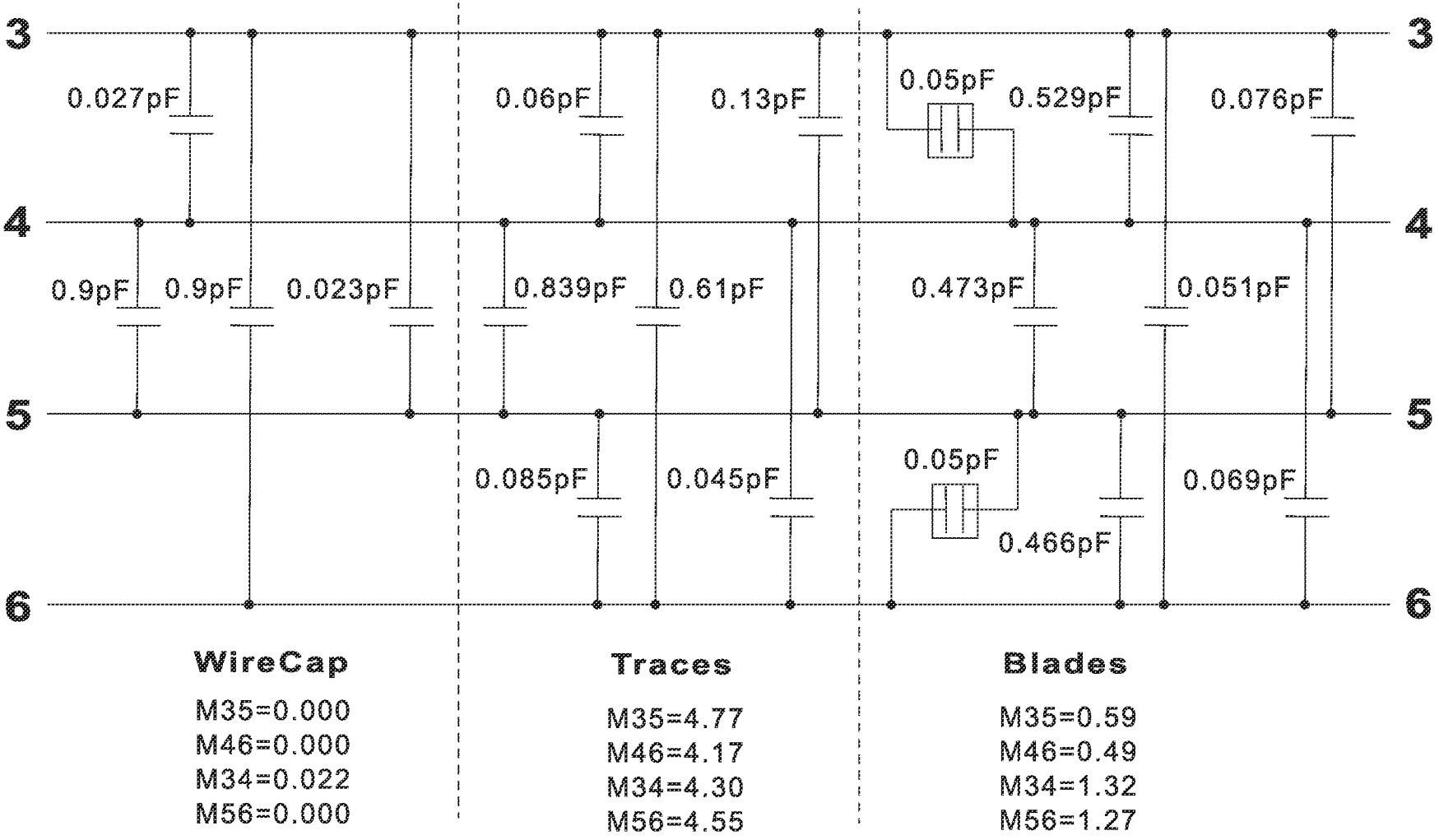

FIG. 35 is the simplified schematic for pair combination 36-45. 34 and 56 crosstalk caps of 0.05 pF is added near blades 3064 in order the bring the overall 36-45 crosstalk magnitude into compliance. Although it is not shown explicitly, it is understood that each conductor exhibits a self inductance. The inductive coupling between these conductors is represented in the schematic by the mutual inductances shown in each major section of the schematic. Note also that adjusted mutual inductive crosstalk M35, M46, M34, and M56 both to achieve proper NEXT and FEXT performance of the plug assembly.

Figure 36:
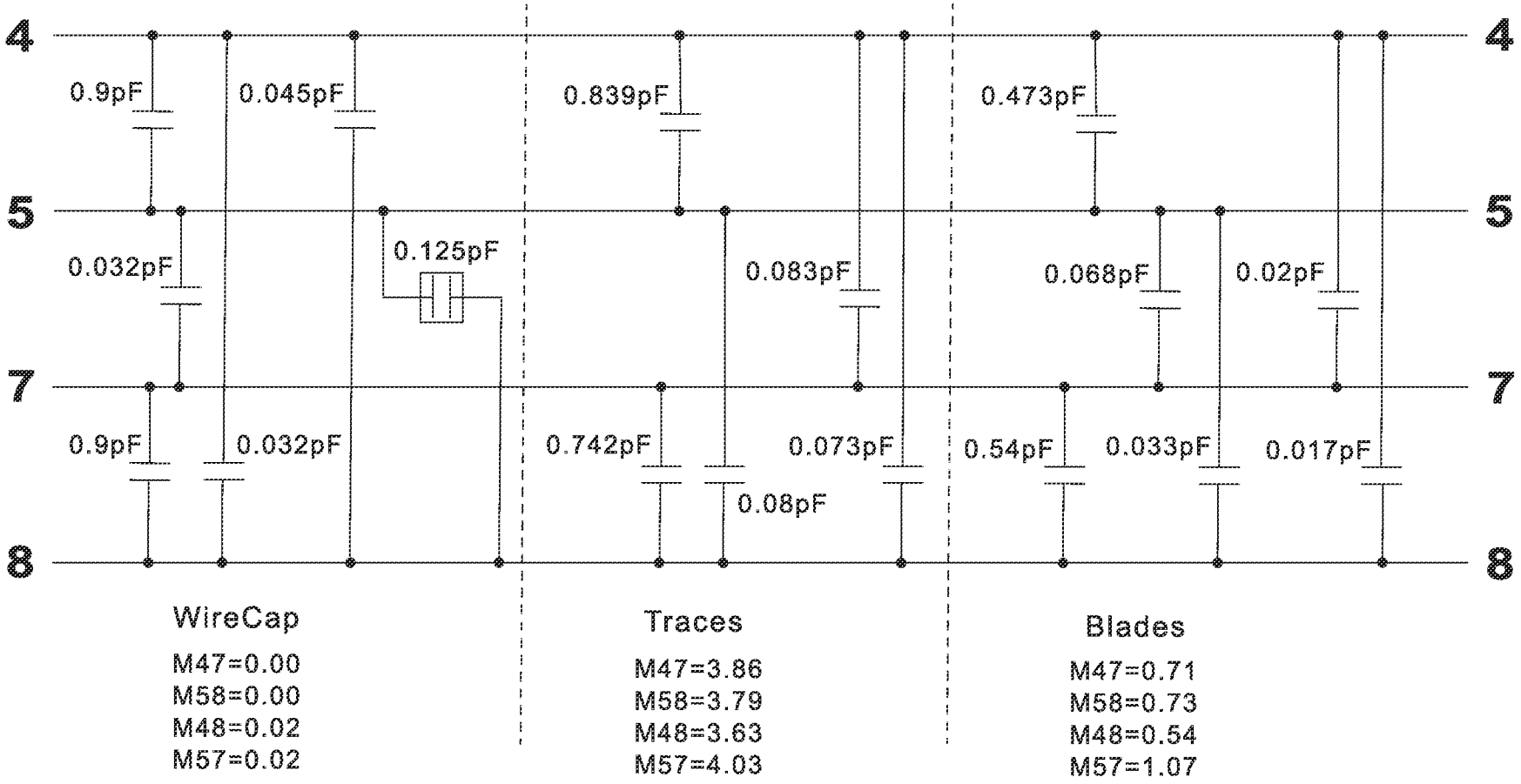

FIG. 36 is the simplified schematic for pair combination 45-78. 58 compensation cap of 0.125 pF is added to PCB 3060 near the plated through holes for IDCs 62 to reduce crosstalk in the back of plug 3020. Although it is not shown explicitly, it is understood that each conductor exhibits a self inductance. The inductive coupling between these conductors is represented in the schematic by the mutual inductance shown in each major section of the schematic.

Figure 37:
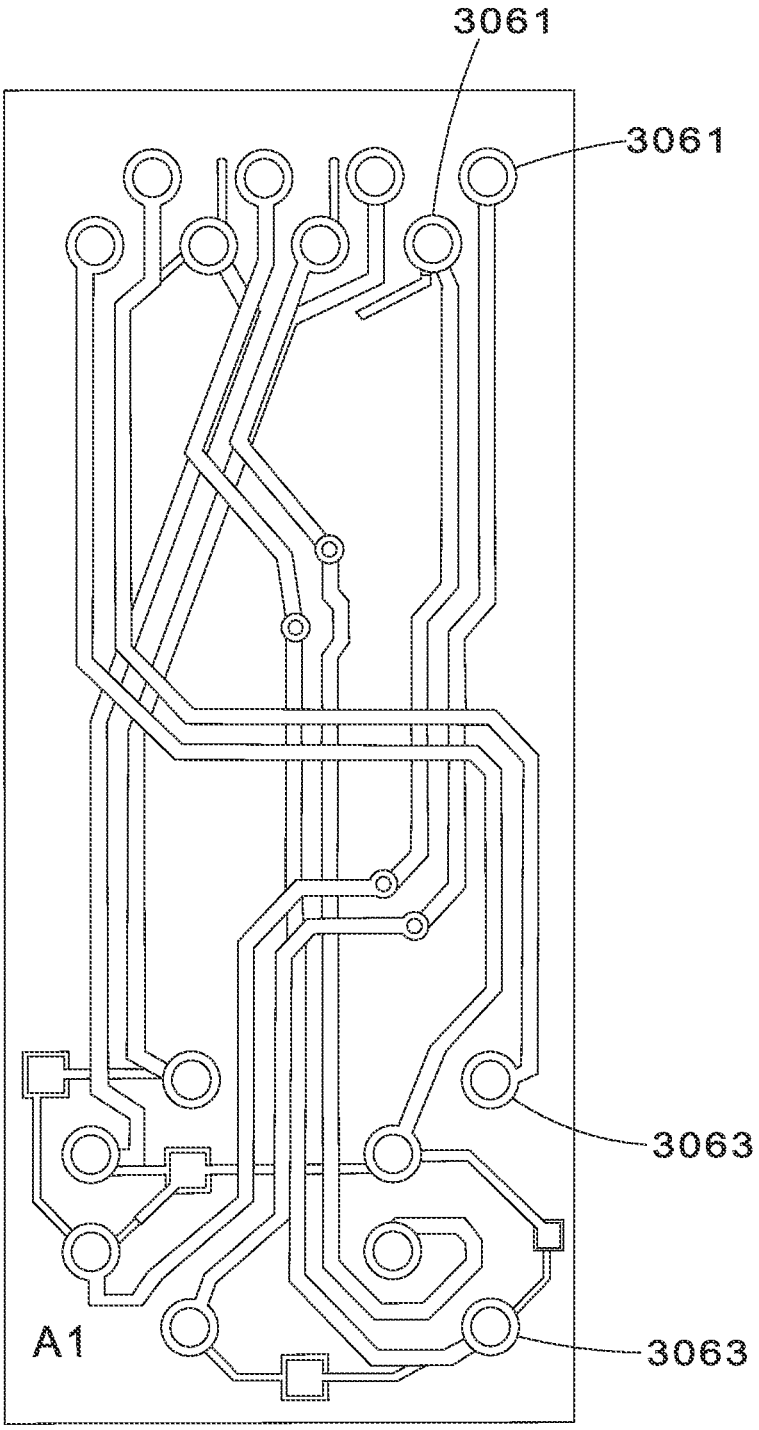
FIG. 37 shows a top view of the PCB layout for the field terminable plug assembly of FIG. 21.

FIG. 37 is the top view of the PCB 3060 layout. All current carrying traces and finger caps for tuning are on the outer top and bottom layers, and the embedded tuning caps are located in the middle $2^{nd}$ and $3^{rd}$ layers. Blade contact vias 3061 are located near the top edge of the image and IDC vias 3063 are located near the bottom edge of the image.

Figure 38:
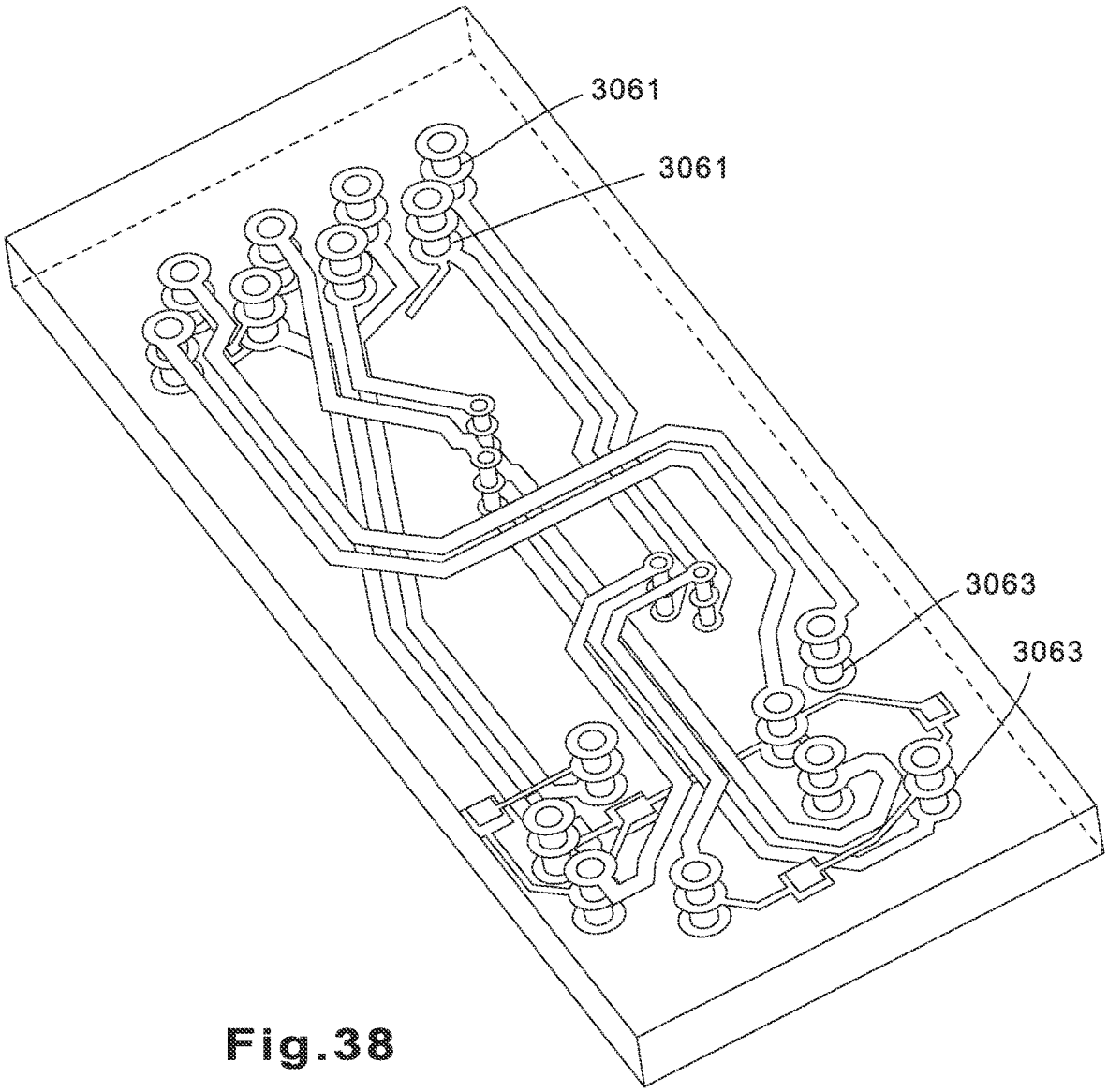
FIG. 38 is a 3-dimensional isometric view of the PCB layout for the field terminable plug assembly of FIG. 21
Figure 39:
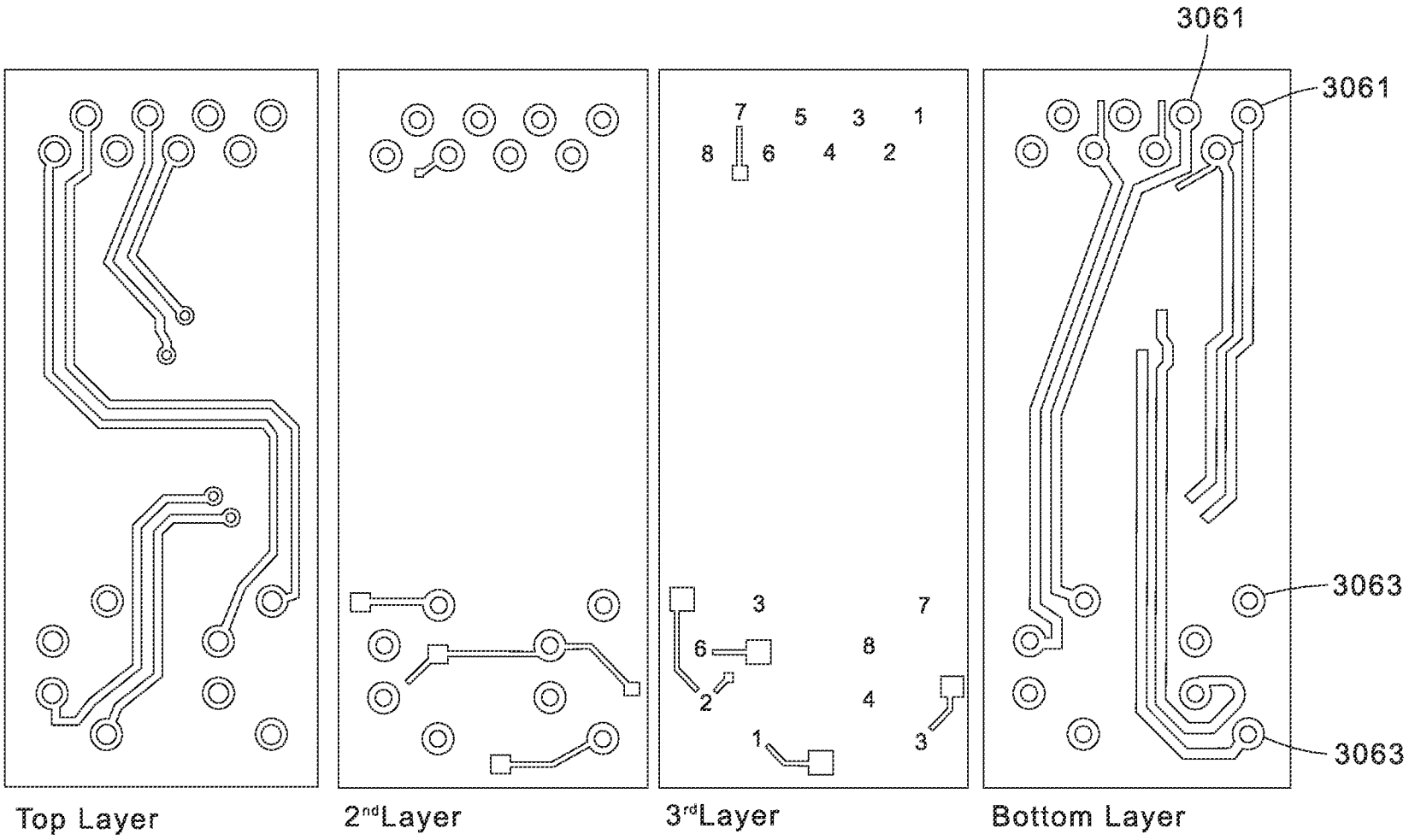
FIG. 39 shows the individual layers for the OCB layout of FIG. 38.

FIG. 38 is a 3-dimensional isometric view of the PCB 60 layout. FIG. 39 shows all 4 individual layers of the PCB 3060 layout.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A field terminable plug comprising:

an upper front plug housing, the upper front plug housing having a latch configured to secure the field terminable plug to a jack;

a lower front plug housing;

an electrical cartridge assembly sandwiched between the upper front plug housing and the lower front plug housing, the electrical cartridge assembly having a latch configured to secure the field terminable plug to a jack; and a rear plug housing secured to the upper front plug housing and the lower front plug housing, the rear plug housing having an opening configured to receive a wire cap wherein the electrical cartridge assembly has a printed circuit board, upper contact support with the latch configured to secure the field terminable plug to a jack, lower contact support, insulation displacement contacts (IDCs) electrically connected to the printed circuit board via lead lines, and plug contacts electrically connected to the printed circuit board and further wherein the wire cap is configured to terminate twisted wire-pairs of a communications cable to the IDCs when the wire cap is inserted into the rear plug housing.

2. The field terminable plug of claim 1 and wherein the IDCs contain at least a first and a second IDC, the first IDC having a first horizontal length and a first vertical length and the second IDC having a second horizontal length and a second vertical length and further wherein the first vertical length does not equal the second vertical length but the first vertical length plus the first horizontal length equals the second vertical length plus the second horizontal length.

3. The field terminable plug of claim 2 wherein each plug contact is oriented 180° from an adjacent plug contact.

4. The field terminable plug of claim 1 wherein the wire cap has a stain relief clip.

5. The field terminable plug of claim 1 further comprising a shield at least partially surrounding the rear plug housing, the upper front plug housing, and the lower front plug housing.

6. A field terminable plug comprising:

a front plug housing, the upper front plug housing having a latch configured to secure the field terminable plug into a jack;

an electrical cartridge assembly contained within the front plug housing, the electrical cartridge assembly having a latch configured to secure the field terminable plug to a jack; and a rear plug housing secured to the front plug housing, the rear plug housing having an opening configured to receive a wire cap wherein:

the electrical cartridge assembly has a printed circuit board, upper contact support with the latch configured to secure the field terminable plug to a jack, lower contact support, insulation displacement contacts electrically connected to the printed circuit board with lead lines, and plug contacts electrically connected to the printed circuit board and further wherein the wire cap is configured to terminate twisted wire-pairs of a communications cable to the IDCs when the wire cap is inserted into the rear plug housing.

7. The field terminable plug of claim 6 and wherein the IDCs contain at least a first and a second IDC, the first IDC having a first horizontal length and a first vertical length and the second IDC having a second horizontal length and a second vertical length and further wherein the first vertical length does not equal the second vertical length but the first vertical length plus the first horizontal length equals the second vertical length plus the second horizontal length.

8. The field terminable plug of claim 7 wherein each plug contact is oriented 180° from an adjacent plug contact.

9. The field terminable plug of claim 6 wherein the wire cap has a strain relief clip.

10. The field terminable plug of claim 6 further comprising a shield at least partially surrounding the rear plug housing and the front plug housing.

* * * * *